US011798797B2

(12) United States Patent
Collings

(10) Patent No.: US 11,798,797 B2
(45) Date of Patent: Oct. 24, 2023

(54) EFFECTIVE POTENTIAL MATCHING AT BOUNDARIES OF SEGMENTED QUADRUPOLES IN A MASS SPECTROMETER

(71) Applicant: DH TECHNOLOGIES DEVELOPMENT PTE. LTD., Singapore (SG)

(72) Inventor: Bruce Collings, Bradford (CA)

(73) Assignee: DH Technologies Development PTE LTD, Singapore (SG)

( * ) Notice: Subject to any disclaimer, the term of this patent is extended or adjusted under 35 U.S.C. 154(b) by 311 days.

(21) Appl. No.: 17/312,907

(22) PCT Filed: Dec. 12, 2019

(86) PCT No.: PCT/IB2019/060729

§ 371 (c)(1),
(2) Date: Jun. 10, 2021

(87) PCT Pub. No.: WO2020/121257

PCT Pub. Date: Jun. 18, 2020

(65) Prior Publication Data

US 2022/0028677 A1 Jan. 27, 2022

Related U.S. Application Data

(60) Provisional application No. 62/779,167, filed on Dec. 13, 2018.

(51) Int. Cl.
*H01J 49/42* (2006.01)
*H01J 49/06* (2006.01)

(52) U.S. Cl.
CPC ..... *H01J 49/426* (2013.01); *H01J 49/063* (2013.01)

(58) Field of Classification Search
CPC ..... H01J 49/426; H01J 49/063
See application file for complete search history.

(56) References Cited

U.S. PATENT DOCUMENTS 6,191,417 B1 2/2001 Douglas et al.
6,987,264 B1 1/2006 Whitehouse
(Continued)

FOREIGN PATENT DOCUMENTS

CA 2270713 A1 10/1999
JP S6182653 A 4/1986

OTHER PUBLICATIONS

International Search Report and Written Opinion for PCT/IB2019/060729 dated Mar. 24, 2020.

*Primary Examiner* — Nicole M Ippolito
*Assistant Examiner* — Hanway Chang

(57) ABSTRACT

Methods and apparatus are disclosed for reducing ion reflections between multipole segments in a mass spectrometer by matching the effective potential between the two segments. Mass spectrometers having at least two multipole segments separated from each other along a longitudinal axis of the mass spectrometer such that a boundary region exists through which ions are drawn from an upstream segment to a downstream segment, and wherein each multipole segment further includes a set of spaced-apart rod-shaped electrodes disposed around the longitudinal axis and having a field radius defined by an inscribed circle between the innermost portions of each electrode. Effective potential matching can be achieved by either supplying RF signals of different amplitudes to each segment and/or by modifying the field strength of the segments. In one embodiment, the multipole segments are configured such that the upstream multipole segment has a smaller field radius than the downstream segment.

20 Claims, 13 Drawing Sheets

(56) References Cited

U.S. PATENT DOCUMENTS

| | | | |
|---|---|---|---|
| 2008/0265154 | A1 | 10/2008 | Cousins et al. |
| 2010/0301210 | A1 | 12/2010 | Bertsch et al. |
| 2017/0256389 | A1 | 9/2017 | Grinfeld et al. |
| 2018/0174817 | A1 | 6/2018 | Green et al. |

EFFECTIVE POTENTIAL MATCHING AT BOUNDARIES OF SEGMENTED QUADRUPOLES IN A MASS SPECTROMETER

RELATED APPLICATION

This application claims priority to U.S. provisional application No. 62/779,167 filed on Dec. 13, 2018, entitled "Effective Potential Matching at Boundaries of Segmented Quadrupoles in a Mass Spectrometer," which is incorporated herein by reference in its entirety.

FIELD

The present teachings are generally related to methods and systems for efficient transfer of ions in a mass spectrometer.

BACKGROUND

Mass spectrometry (MS) is an analytical technique for determining the elemental composition of substances that has both quantitative and qualitative applications. For example, MS can be useful for identifying unknown compounds, determining the isotopic composition of elements in a molecule, and determining the structure of a particular compound by observing its fragmentation, as well as for quantifying the amount of a particular compound in a sample.

A typical mass spectrometer system generally includes at least the following three components: an ion source, a mass analyzer, and a detector. In general, a compound to be analyzed is introduced into the system in liquid or gas form and the ion source operates to ionize the compound, for instance, by adding or subtracting charges to make neutral molecules of the compound into charged ions. The mass analyzer manipulates and separates the ions according to their mass-to-charge (m/z) ratios within the mass spectrometer by using electric and/or magnetic fields.

If the charge of a given ion is known, then the molecular mass of that ion, and thus the neutral analyte molecule, may be determined based on the ions contacting or passing by the detector. For example, the detector may record an induced charge or current when an ion passes by or hits a surface of the detector. In another example, a detector may produce a signal during the course of a scan based on where the mass analyzer is in the scan (e.g., the mass-to-charge ratio (m/z) of the ions), thus producing a mass spectrum of ions as a function of m/z.

Numerous types of mass spectrometers have been developed, each with its own set of advantages, disadvantages, and analytical applications. For example, ion trap mass spectrometers use multipole electrode structures to form trapping chambers (e.g., "ion traps") to contain ions by means of electrostatic and electrodynamic fields. An example of such a multipole mass filter is a linear 2D quadrupole ion trap mass spectrometer. This type of mass spectrometer operates by superimposing a high-frequency (e.g., radio frequency (RF)) voltage onto a direct current (DC) voltage of four rod electrodes to form a quadrupole electrodynamic field that confines the ions radially. Axially, ions are confined using DC voltage barriers provided by end side lenses. Trapped ions are cooled through collisions with the background gas molecules and ejected axially in a mass-selective fashion, for example, by the ramping of the amplitude of the main RF drive, causing ions of increasingly higher m/z to interact with a dipolar auxiliary signal applied between two opposing rods. As these ions become more active due to the dipolar excitation signal, they can escape the ion trap and pass to the detector sequentially depending upon their mass and charge.

Generally, quadrupole mass filters (QMFs) consist of four parallel conductive rods or elongated electrodes arranged such that their centers form the corners of a square and whose opposing poles are electrically connected. Most commonly, the electric potential ($U-V \cos \Omega t$) is applied to one of the poles and ground and the electrical potential $-(U-V \cos \Omega t)$ is applied between the other pole and the ground. The motion of an ion in the x- and y-directions along these mass filters is described by the Mathieu equation, whose solutions show that ions in a particular mass-to-charge ratio range can be transmitted from the mass filter's output end along the z-axis. See, for example, U.S. Pat. No. 2,939,952 to Paul, which is incorporated by reference in its entirety.

Quadrupole fields can be created by four electrodes with hyperbolic cross sections $x^2-y^2=r_0^2$, where $r_0$ (the field radius) is the radius of an inscribed circle between the innermost portions of each electrode. In practice, cylindrical (or round) electrodes are often used because they are much easier to fabricate and align, with the geometry of a quadrupole rod set being characterized by the $R/r_0$ ratio where R is the rod radius and $r_0$ is the radius of an inscribed circle that touches the electrode tips.

Many modern MS systems employ multiple quadrupole rod sets, with some functioning as QMF stages (e.g., a Q0 stage, a Q1 stage, and a Q3 stage) and others responsible for other ion processing (e.g., an ion guide (sometimes designated as Q0) a collision cell (sometimes designated as Q2) between Q1 and Q3). For example, in tandem mass spectrometry (MS/MS), ions generated from an ion source are captured and directed in a Q0 ion guide stage, and then mass selected in a first stage (e.g., a Q1 mass filter stage) to obtain precursor ions. The precursor ions can be fragmented in a second stage (e.g., a Q2 collision stage) to generate product ions, after which the product ions are axially ejected onto a detector in a mass-selective manner (e.g., in a Q3 mass analyzer stage that receives product and/or precursor ions from Q2). The various stages are typically separated from each other by lenses which can also take a quadrupolar form. One common form is a short or stubby (ST) quadrupole rod set, also known as a Brubaker lens, which when placed before Q1 is generally designated herein as pre-filter ST1. In addition, each of the quadrupole stages themselves can also be segmented into two or more quadrupole elements.

However, because fringing fields can exist at each boundary between quadrupole elements in the system (e.g., within a segmented Q0 quadrupole or at a ST1/Q1 boundary), undesirable ion reflections can occur and can result in reflected ions being trapped within the upstream quadrupole. Such reflections can result in unstable ion beams, increased ion transit times, and/or degraded mass discrimination (e.g., by loss of signal or cross-talk). Such issues are further exacerbated for higher intensity ion currents (e.g., for larger sampling orifices) because increases in repulsive forces between ions of the same charge lead to greater radial spread of the ion beam, thereby subjecting more ions to the fringing fields.

Accordingly, there exists a need to reduce unwanted reflections at boundaries between quadrupole elements in MS systems.

SUMMARY

Methods and apparatus are disclosed for reducing ion reflections between multipole segments in a mass spectrometer. Whereas fringing fields existing at boundary regions between conventional adjacent quadrupole rod sets can undesirably cause reflections of ions back toward the upstream rod set, rod sets configured in accordance with methods and systems described herein decrease reflections and improve the transmission/stability of the ion beam by setting the effective potential of the upstream rod set to be greater than or equal to the effective potential of the downstream rod set. As discussed below, the repulsive force caused by the fringing fields can be reduced by adjusting the amplitude of the RF signals applied to each of the rod sets relative to one another and/or by modifying the relative field strength of the rod sets (e.g., by changing the field radius of one of the quadrupoles relative to the other).

In accordance with various aspects of the present teachings, a method of reducing ion reflections between multipole segments in a mass spectrometer is provided comprising generating an ion beam comprising a plurality of ions; directing the ion beam through at least two multipole segments of a mass spectrometer, wherein each multipole segment includes a set of spaced-apart rod-shaped electrodes and a central opening through which ions can pass along a longitudinal axis and wherein the multipole segments are separated from each other by at least one boundary region along said longitudinal axis through which ions are drawn from an upstream segment to a downstream segment; and applying electrical signals to each of the rod-shaped electrodes of the upstream and downstream segments to set the effective potential of each segment and such that the effective potential of the upstream rod set is greater than or substantially equal to the effective potential of the downstream rod set so as to reduce reflection of ions passing through the boundary region.

In certain aspects, each of the multipole segments has a field radius defined by an inscribed circle between the innermost portions of each electrode, wherein the multipole segments are configured such that the field radius of the upstream segment is smaller than the field radius of the downstream segment. In particular aspects, each of the upstream and downstream multipole segments is a quadrupole rod set having four cylindrical electrodes, the geometry of each quadrupole rod set being characterized by a ratio $R/r_0$, where R is the rod radius and $r_0$ is the radius of an inscribed circle that touches the electrode tips, and wherein $r_0$ of the upstream quadrupole rod set is at least 5 percent less than the $r_0$ of the downstream quadrupole rod set. Additionally, in some aspects, the rod radius, $R_{up}$, of the rods of the upstream rod set is smaller than the $R_{down}$ of the rods of the downstream rod set. For example, the rod radius, $R_{up}$, of the rods of the upstream rod set may be at least 5 percent smaller than the $R_{down}$ of the rods of the downstream rod set and/or such that each rod set has substantially the same ratio $R/r_0$ as the other.

In some embodiments, one of the upstream and downstream multipole segments are circumferentially rotated about the longitudinal axis relative to the other of the upstream and downstream multipole segments. For example, one of the upstream and downstream multipole segments may be circumferentially rotated relative to the other by at least 5 degrees. In some implementations, one of the upstream and downstream multipole segments is circumferentially rotated relative to the other in range from about 25 degrees to about 45 degrees. Additionally or alternatively, each of the rod-shaped electrodes of the upstream segment may extend along a central axis, wherein the central axis of each of the rod-shaped electrodes of the upstream segment is not parallel to the longitudinal axis.

The present teachings are applicable to a variety of adjacent quadrupoles separated by a boundary region. For example, the upstream multipole segment may be a portion of a segmented Q0 ion guide. In alternative aspects, the upstream multipole segment may be an Brubaker pre-filter.

In certain aspects, the electrical signals applied to each of the rod-shaped electrodes of the upstream and downstream segments are selected such that the q value of the upstream segment is equal to or greater than the q value of the downstream segment.

The present teachings also provide a mass spectrometer comprising: at least two multipole segments adjacent to each other along a longitudinal axis of the mass spectrometer such that a boundary region exists through which ions are transmitted from an upstream segment to a downstream segment; each multipole segment further comprising a set of spaced-apart rod-shaped electrodes disposed around the longitudinal axis and having a field radius defined by an inscribed circle between the innermost portions of each electrode, and one or more power supplies configured to provide electrical signals to each of the rod-shaped electrodes of the upstream and downstream segments, wherein an effective potential of the upstream rod set is greater than or substantially equal to the effective potential of the downstream rod set so as to reduce reflection of ions transmitted through the boundary region.

In certain aspects, the upstream multipole segment exhibits a smaller field radius than the downstream segment. For example, in some aspects, each of the upstream and downstream multipole segments comprises a quadrupole rod set having four cylindrical electrodes, the geometry of each quadrupole rod set being characterized by a ratio $R/r_0$, where R is the rod radius and $r_0$ is the radius of an inscribed circle that touches the electrode tips, and wherein $r_0$ of the upstream quadrupole rod set is at least 5 percent less than the $r_0$ of the downstream quadrupole rod set. Additionally, in certain related aspects, the rod radius $R_{up}$ of the rods of the upstream rod set is smaller than the $R_{down}$ of the rods of the downstream rod set. For example, the rod radius, $R_{up}$ may be at least 5 percent smaller than $R_{down}$ and/or such that each rod set has substantially the same ratio $R/r_0$ as the other.

Additionally or alternatively, in some aspects, one of the upstream and downstream multipole segments is circumferentially rotated about the longitudinal axis relative to the other of the upstream and downstream multipole segments. For example, one of the upstream and downstream multipole segments may be circumferentially rotated relative to the other by at least 5 degrees. In certain aspects, the upstream and downstream multipole segments are circumferentially rotated relative to one another by an angle in a range from about 25 degrees to about 45 degrees. Additionally or alternatively, in certain aspects each of the rod-shaped electrodes of the upstream segment extends along a central axis and wherein the central axis of each of the rod-shaped electrodes of the upstream segment is not parallel to the longitudinal axis.

In certain aspects, the electrical signals applied to each of the rod-shaped electrodes of the upstream and downstream segments are selected such that the q value of the upstream segment is equal to or greater than the q value of the downstream segment.

These and other features of the applicant's teaching are set forth herein.

BRIEF DESCRIPTION OF THE DRAWINGS

The foregoing and other objects and advantages of the invention will be appreciated more fully from the following further description, with reference to the accompanying drawings. The skilled person in the art will understand that the drawings, described below, are for illustration purposes only. The drawings are not intended to limit the scope of the applicant's teachings in any way.

DETAILED DESCRIPTION

It will be appreciated that for clarity, the following discussion will explicate various aspects of embodiments of the applicant's teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicant's teachings may not require certain of the specifically described details in every implementation, which are set forth herein only to provide a thorough understanding of the embodiments. Similarly, it will be apparent that the described embodiments may be susceptible to alteration or variation according to common general knowledge without departing from the scope of the disclosure. The following detailed description of embodiments is not to be regarded as limiting the scope of the applicant's teachings in any manner. As used herein, the terms "about" and "substantially equal" refer to variations in a numerical quantity that can occur, for example, through measuring or handling procedures in the real world; through inadvertent error in these procedures; through differences in the manufacture, source, or purity of compositions or reagents; and the like. Typically, the terms "about" and "substantially" as used herein means greater or lesser than the value or range of values stated by 1/10 of the stated values, e.g., ±10%. For instance, a concentration value of about 30% or substantially equal to 30% can mean a concentration between 27% and 33%. The terms also refer to variations that would be recognized by one skilled in the art as being equivalent so long as such variations do not encompass known values practiced by the prior art.

Whereas fringing fields existing at boundary regions between adjacent quadrupole rod sets can undesirably cause reflections of ions from the boundary region back toward the upstream rod set, adjacent quadrupole rod sets configured in accordance with methods and systems described herein decrease reflections and improve the transmission/stability of the ion beam such that the effective potential of the upstream rod set is greater than or equal to the effective potential of the downstream rod set. As discussed in detail below, the repulsive force caused by the fringing fields can be reduced by adjusting the amplitude of the RF signals applied to each of the rod sets relative to one another and/or by modifying the relative field strength of the rod sets (e.g., by changing the field radius of one of the quadrupoles relative to the other).

Figure 1:
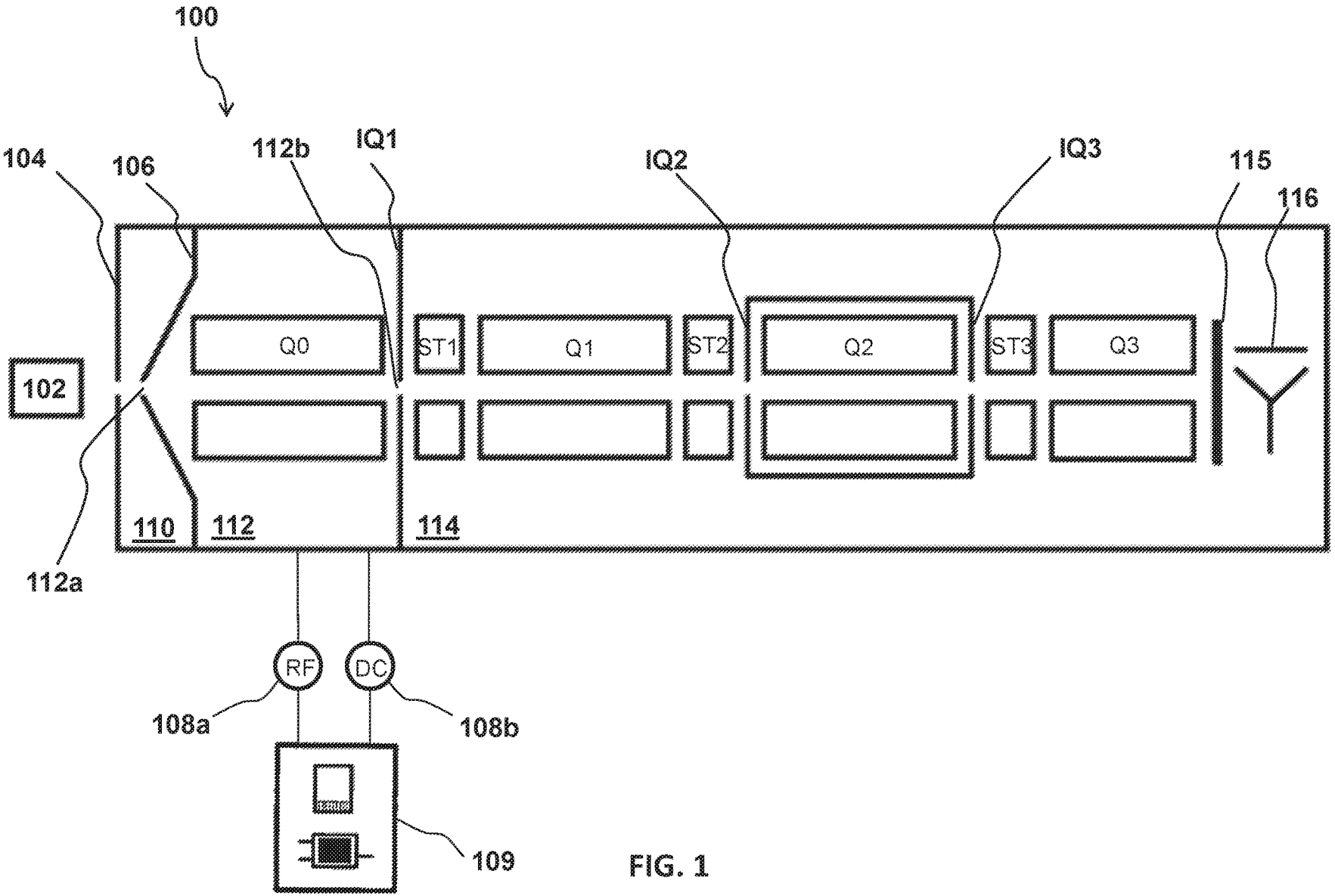
FIG. 1 is a schematic illustration of a mass spectrometry system according to various aspects of the present teachings.

While systems, devices, and methods described herein can be used in conjunction with many different mass spectrometry systems, an exemplary mass spectrometry system 100 for such use in accordance with the present teachings is illustrated schematically in FIG. 1. It should be understood that mass spectrometry system 100 represents only one possible mass spectrometry system for use in accordance with embodiments of systems, devices, and methods described herein. Moreover, other mass spectrometry systems having other configurations can all be used in accordance with the systems, devices and methods described herein as well. As shown schematically in the exemplary embodiment depicted in FIG. 1, the mass spectrometry system 100 generally includes a QTRAP® Q-q-Q hybrid linear ion trap mass spectrometry system, as generally described in an article entitled "Product ion scanning using a Q-q-$Q_{linear}$ ion trap (Q TRAP®) mass spectrometer," authored by James W. Hager and J. C. Yves Le Blanc and published in Rapid Communications in Mass Spectrometry (2003; 17: 1056-1064), which is hereby incorporated by reference in its entirety, and modified in accordance with various aspects of the present teachings. Other non-limiting, exemplary mass spectrometry systems that can be modified in accordance with the systems, devices, and methods disclosed herein can be found, for example, in U.S. Pat. No. 7,923,681, entitled "Collision Cell for Mass Spectrometer," which is hereby incorporated by reference in its entirety. Other configurations, including but not limited to those described herein and others known to those skilled in the art, can also be utilized in conjunction with the systems, devices, and methods disclosed herein.

As shown in FIG. 1, the exemplary mass spectrometry system 100 can include an ion source 102, a collision focusing ion guide Q0 housed within a first vacuum chamber 112, one or more mass analyzers housed within a second vacuum chamber 114, and a detector 116. Though the exemplary second vacuum chamber 114 is depicted as housing three quadrupoles (i.e., elongated rod sets mass filter Q1, collision cell Q2, and mass filter Q3), it will be appreciated that more or fewer mass analyzer or ion processing elements can be included in systems in accordance with the present teachings. For convenience, the elongated rod sets Q1, Q2, and Q3 are generally referred to herein as quadrupoles (that is, they have four rods), though the elongated rod sets may be other suitable multipole configurations. For example, collision cell Q2 can be a hexapoles, octapoles, etc. It will also be appreciated that the mass spectrometry system can comprise any of triple quadrupoles, linear ion traps, quadrupole time of flights, Orbitrap or other Fourier transform mass spectrometry systems, all by way of non-limiting examples.

Each of the various stages of the exemplary mass spectrometer system 100 will be discussed in additional detail with reference to FIG. 1. Initially, the exemplary ion source 102 is generally configured to generate ions from a sample to be analyzed and can comprise any known or hereafter developed ion source modified in accordance with the present teachings. Non-limiting examples of ion sources suitable for use with the present teachings include atmospheric pressure chemical ionization (APCI) sources, electrospray ionization (ESI) sources, continuous ion source, a pulsed ion source, an inductively coupled plasma (ICP) ion source, a matrix-assisted laser desorption/ionization (MALDI) ion source, a glow discharge ion source, an electron impact ion source, a chemical ionization source, or a photo-ionization ion source, among others.

During operation of the mass spectrometry system 100, ions generated by the ion source 102 can be extracted into a coherent ion beam, the ions of which are successively processed by the one or more mass analyzers disposed within one or more vacuum chambers that are evacuated to sub-atmospheric pressures as is known in the art. Ions generated by the ion source 102 are initially drawn through an aperture in a sampling orifice plate 104. As shown, ions pass through an intermediate pressure chamber 110 located between the orifice plate 104 and the skimmer 106 (e.g., evacuated to a pressure approximately in the range of about 1 Torr to about 4 Torr by a mechanical pump (not shown)) and are then transmitted through an inlet orifice 112*a* to enter a collision focusing ion guide Q0 so as to generate a narrow and highly focused ion beam. In various embodiments, the ions can traverse one or more additional vacuum chambers and/or quadrupoles (e.g., a QJet® quadrupole or other RF ion guide) that utilize a combination of gas dynamics and radio frequency fields to enable the efficient transport of ions with larger diameter sampling orifices. However, as shown, the collision focusing ion guide Q0 generally includes a quadrupole rod set comprising four rods surrounding and parallel to the longitudinal axis along which the ions are transmitted. As is known in the art, the application of various RF and/or DC potentials to the components of the ion guide Q0 causes collisional cooling of the ions (e.g., in conjunction with the pressure of vacuum chamber 112) and transmitted through the exit aperture in IQ1 (e.g., an orifice plate) into the downstream mass analyzers for further processing. The vacuum chamber 112, within which the ion guide Q0 is housed, can be associated with a pump (not shown, e.g., a turbomolecular pump) operable to evacuate the chamber to a pressure suitable to provide such collisional cooling. For example, the vacuum chamber can be evacuated to a pressure approximately in the range of about 1 mTorr to about 30 mTorr, though other pressures can be used for this or for other purposes. For example, in some aspects, the vacuum chamber 112 can be maintained at a pressure such that pressure×length of the quadrupole rods is greater than $2.25\times10^{-2}$ Torr-cm. The lens IQ1 disposed between the vacuum chamber 112 of Q0 and the adjacent chamber 114 isolates the two chambers and includes an aperture 112*b* through which the ion beam is transmitted from Q0 into the downstream chamber 114 for further processing. It should be noted that although Q0 is depicted as a single, quadrupole rod set, a person skilled in the art will appreciate that the teachings provided herein regarding reflections at the boundary region between quadrupole rod sets would be equally applicable, for example, to a segmented Q0 comprising adjacent rod sets.

As shown in FIG. 1, in some embodiments, the system 100 includes various sets of stubby rods (generally referred to herein as designated pre-filter ST1, post-filter ST2, pre-filter ST3 herein) between neighboring pairs of quadrupole rod sets to facilitate the transfer of ions therebetween. Also referred to in the art as Brubaker lenses after the inventor of U.S. Pat. No. 3,129,327, each of these stubby rod sets typically comprises four short, cylindrical electrodes disposed at the entrance and/or exit of quadrupole mass filters with each rod being mounted co-linearly with the rods of the QMF. Commonly, each stubby rod in a Brubaker pre-filter is capacitively coupled to the corresponding rod of the QMF such that only a fraction of the AC potential applied to the QMF rod is also applied to each corresponding stubby rod. Because the resolving DC voltage of the downstream QMF rods (i.e., ±U, as discussed below) is not applied to the Brubaker lens, there is a delay in subjecting the ions to the DC field caused by the QMF's resolving DC such that ions generally do not pass through a region of instability along the Y-coordinate (when the polarity of the resolving voltage is negative (−U)). In sum, Brubaker pre-filters generally act as high-pass filters for ions transmitted therethrough and results in a reduction of the defocusing caused by the fringing fields as ions are transmitted from one element to another, thereby enhancing the transmission efficiency of ions into the downstream QMF. Despite this increase in the transmission efficiency from standard Brubaker pre-filters, the fringing fields existing between conventional pre-filters and their downstream QMFs can nonetheless cause significant transmission loss due to reflections by the even-minimized fringing fields present at the boundary regions. As will be discussed in additional detail below with reference to FIGS. 2C-D, such reflected ions can be neutralized within the stubby rod set and/or can become trapped therein. However, by adjusting the effective potentials across the boundary region in accordance with various aspects of the present teachings, stubby rod sets can be operated to further reduce such reflections and the occurrence of trapping relative to conventional pre-filter/QMF configurations, thereby further increasing transmission efficiency, ion beam stability, and/or eliminating the need to empty any ions trapped within the upstream quadrupole for the systems and methods disclosed herein. Indeed, with reference again to FIG. 1, each of the quadrupole segments, e.g., Q1, Q2 or Q3—as well as the ST lenses interspersed between the QMFs—presents a potential boundary where undesired ion reflections can occur as ions are passed through the mass spectrometer system 100. Accordingly, it will be appreciated that the present teachings, exemplified with reference to the boundary region between ST1 and Q1 of FIG. 1, are also applicable to the boundary region between any quadrupole as well as to a segmented Q0 comprising adjacent rod sets, for example.

After being transmitted from Q0 through the exit aperture 112*b* of the lens IQ1, the ions enter the adjacent quadrupole rod set Q1 via ST1, which can be situated in a vacuum chamber 114 that can be evacuated to a pressure than can be maintained lower than that of ion guide chamber 112, for example, due to the pumping provided by a turbomolecular pump (not shown). By way of non-limiting example, the vacuum chamber 114 can be maintained at a pressure less than about $1\times10^{-4}$ Torr (e.g., about $5\times10^{-5}$ Torr), though other pressures can be used for this or for other purposes. As will be appreciated by a person of skill in the art, the quadrupole rod set Q1 can be operated as a conventional transmission RF/DC quadrupole mass filter that can be operated to select an ion of interest and/or a range of ions of interest. By way of example, the quadrupole rod set Q1 can be provided with RF/DC voltages suitable for operation in a mass-resolving mode. As should be appreciated, taking the physical and electrical properties of Q1 into account, parameters for an applied RF and DC voltage can be selected so that Q1 establishes a transmission window of chosen m/z ratios, such that these ions can traverse Q1 largely unperturbed. Ions having m/z ratios falling outside the window, however, do not attain stable trajectories within the quadrupole and can be prevented from traversing the quadrupole rod set Q1. It should be appreciated that this mode of operation is but one possible mode of operation for Q1. By way of example, the lens IQ2 between Q1 and Q2 can be maintained at a much higher offset potential than Q1 such that the quadrupole rod set Q1 be operated as an ion trap. In such a manner, the potential applied to the entry lens IQ2 can be selectively lowered (e.g., mass selectively scanned) such that ions trapped in Q1 can be accelerated into Q2, which could also be operated as an ion trap, for example.

Ions passing through the quadrupole rod set Q1 can pass through post-filter ST2 (like ST1, ST2 is also a set of RF-only stubby rods but that improves transmission of ions exiting a quadrupole) and the lens IQ2 and into the adjacent quadrupole rod set Q2, which as shown can be disposed in a pressurized compartment and can be configured to operate as a collision cell at a pressure approximately in the range of from about 1 mTorr to about 30 mTorr, though other pressures can be used for this or for other purposes. A suitable collision gas (e.g., nitrogen, argon, helium, etc.) can be provided by way of a gas inlet (not shown) to thermalize and/or fragment ions in the ion beam. In some embodiments, application of suitable RF/DC voltages to the quadrupole rod set Q2 and entrance and exit lenses IQ2 and IQ3 can provide optional mass filtering.

Ions that are transmitted by Q2 can pass into the adjacent quadrupole rod set Q3, which is bounded upstream by IQ3 and ST3 (which functions substantially similar to pre-filter ST1 but for Q3) and downstream by the exit lens 115. As will be appreciated by a person skilled in the art, the quadrupole rod set Q3 can be operated at a decreased operating pressure relative to that of Q2, for example, less than about $1\times10^{-4}$ Torr (e.g., about $5\times10^{-5}$ Torr), though other pressures can be used for this or for other purposes. As will be appreciated by a person skilled in the art, Q3 can be operated in a number of manners, for example as a scanning RF/DC quadrupole or as a linear ion trap. Following processing or transmission through Q3, the ions can be transmitted into the detector 116 through the exit lens 115. The detector 116 can then be operated in a manner known to those skilled in the art in view of the systems, devices, and methods described herein. As will be appreciated by a person skilled in the art, any known detector, modified in accord with the teachings herein, can be used to detect the ions.

The exemplary mass spectrometry system 100 of FIG. 1 additionally includes one or more power supplies 108*a,b* that can be controlled by a controller 109 so as to apply electric potentials with RF, AC, and/or DC components to the quadrupole rods, the various lenses, and auxiliary electrodes to configure the elements of the mass spectrometry system 100 for various different modes of operation depending on the particular MS application. It will be appreciated that the controller 109 can also be linked to the various elements in order to provide joint control over the executed timing sequences. Accordingly, the controller 109 can be configured to provide control signals to the power source(s) 108*a,b* supplying the various components in a coordinated fashion in order to control the mass spectrometry system 100 as otherwise discussed herein. By way of example, the controller 109 may include a processor for processing information, data storage for storing mass spectra data, and instructions to be executed. It will be appreciated that though controller 109 is depicted as a single component, one or more controllers (whether local or remote) may be configured to cause the mass spectrometer system 100 to operate in accordance with any of the methods described herein. Additionally, in some implementations, the controller 109 may be operatively associated with an output device such as a display (e.g., a cathode ray tube (CRT) or liquid crystal display (LCD) for displaying information to a computer user) and/or an input device including alphanumeric and other keys and/or cursor control for communicating information and command selections to the processor. Consistent with certain implementations of the present teachings, the controller 109 executes one or more sequences of one or more instructions contained in data storage, for example, or read into memory from another computer-readable medium, such as a storage device (e.g., a disk). The one or more controller(s) may take a hardware or software form, for example, the controller 109 may take the form of a suitably programmed computer, having a computer program stored therein that is executed to cause the mass spectrometer system 100 to operate as otherwise described herein, though implementations of the present teachings are not limited to any specific combination of hardware circuitry and software. Various software modules associated with the controller 109, for example, may execute programmable instructions to perform the exemplary methods described below with reference to FIG. 4.

Figure 2A:
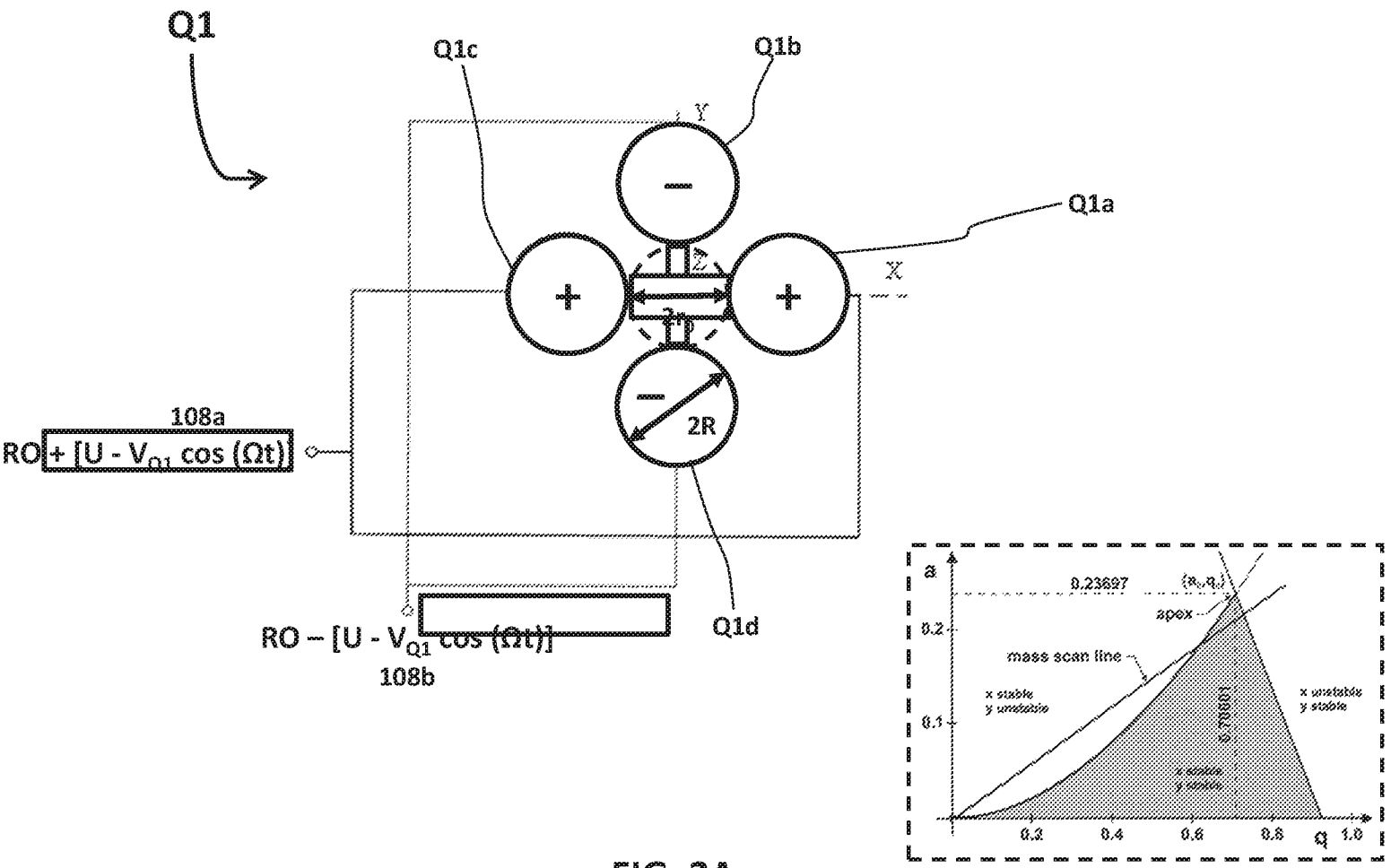
FIG. 2A is a schematic illustration of a conventional first stage quadrupole mass filter (designated Q1 herein) known in the art.

With reference now to FIG. 2A, a schematic illustration of quadrupole mass filter depicts mass filter Q1, which consists of four parallel rod electrodes Q1a-d that are disposed around and parallel to a central longitudinal axis (Z) extending from an inlet end (e.g., toward the ion source) to an outlet end (e.g., toward Q2). As shown in cross-section, the rods Q1a-d comprise rods having a cylindrical shape (i.e., a circular cross-section of radius R as shown in FIG. 2A) disposed equidistant from the central axis (Z), with each of the rods Q1a-d being equivalent in size and shape to one another. The minimum distance between each of the rods Q1a-d and the central axis (Z) is defined by the distance $r_0$ such that the innermost surface of each primary rod Q1a-d is separated from the innermost surface of the other rod in its rod pair across the central longitudinal axis (Z) by a minimum distance of $2r_0$. It will be appreciated that though the rods Q1a-d are depicted as cylindrical, the cross-sectional shape, size, and/or relative spacing of the rods Q1a-d may be varied as is known in the art. For example, in some aspects, the rods Q1a-d can exhibit a radially internal hyperbolic surface according to the equation $x^2-y^2=r_0^2$, where $r_0$ (the field radius) is the radius of an inscribed circle between the electrodes in order to generate quadrupole fields.

The rods Q1a-d are electrically conductive (i.e., they can be made of any conductive material such as a metal or alloy) and can be coupled to a power system (comprising one or more power supplies 108*a,b* of FIG. 1) such that one or more electrical signals can be applied to each rod Q1a-d alone or in combination. In particular, the rods Q1a-d generally comprise two pairs of rods (e.g., a first pair comprising rods Q1a and Q1c and a second pair comprising rods Q1b and Q1d), with rods of each pair being disposed on opposed sides of the central axis (Z) and to which identical electrical signals can be applied. For example, in some aspects as illustrated in FIG. 2A, the power system can comprise a power supply 108*a* electrically coupled to the first pair of rods Q1a,c so as to apply identical electric potentials thereto and a power supply 108*b* electrically coupled to the second pair of rods Q1b,d for applying a different electrical signal thereto. As shown in FIG. 2A, in some implementations the exemplary power system can apply an electric potential to the first pair of rods Q1a,c of a rod offset voltage (RO)+[$U-V_{Q1}$ cos Ωt], where U is the magnitude of the DC electrical signal, $V_{Q1}$ is the zero-to-peak amplitude of the AC or RF signal, S2 is the angular frequency of the AC or RF signal, and t is time. Similarly, the exemplary power system can apply an electric potential to the second pair of rods Q1b,d of RO−[$U-V_{Q1}$ cos Ωt]. In this exemplary configuration, the electrical signals applied to the first pair of rods Q1a,c and the second pair of rods Q1b,d differ in the polarity of the DC signal (i.e., the sign of U), while the RF portions of the electrical signals would be 180° out of phase with one another. It will thus be appreciated by a person skilled in the art that the quadrupole rod set Q1 may in some aspects be configured as a quadrupole mass filter that selectively transmits ions of a selected m/z range by a suitable choice of the DC/RF ratio. For example, considering the DC electrical signals applied to the four primary rods Q1a-d alone (i.e., ±U), a cation injected into the quadrupole rod set Q1 as shown in FIG. 2A would experience a stabilizing force (toward the central axis Z) in the X-Z plane based on the application of a positive DC voltage to the first pair of electrodes Q1a,c, while the cation would experience a destabilizing force in the Y-Z plane based on the application of a negative DC voltage to the second pair of electrodes Q1b,d. Considering the effect of the RF signal alone, a cation would be sequentially attracted and repelled by the various rod pairs Q1a,c and Q1b,d as the RF signals applied to the rod pairs change over time. Because cations of low m/z are more easily able to follow the alternating component of the field, low m/z cations would tend to stay more in phase with the RF signal, gain energy from the field, and oscillate with increasingly large amplitude until they encounter one of the rods Q1a-d and are discharged. Now, considering the effect of the combined DC and RF signals, it will be appreciated that the field in the X-Z plane would function as a high-pass mass filter in that only ions of high m/z will be transmitted to the other end of the quadrupole without striking the first pair of electrodes Q1a,c. On the other hand, in the Y-Z plane, cations of high m/z will be unstable because of the defocusing/attractive effect of the negative DC voltage, though some ions of lower m/z may be stabilized by the RF component if its amplitude is set so as to correct the trajectory whenever the cation's deviation increases. Thus, the field in the Y-Z plane can be said to function as a low-pass mass filter in that only ions of lower m/z will be transmitted to the other end of the quadrupole rod set Q1 without striking the second pair of rods Q1b,d.

As noted above and is known in the art, by a suitable choice of the RF/DC ratio of the electrical signals applied to the quadrupole rod set Q1, the two effects described above in the X-Z plane and Y-Z plane together provide a mass filter capable of resolving individual atomic masses, as depicted in the exemplary inset Mathieu stability diagram of the following parameters:

$$a = a_x = -a_y = \frac{4eU}{mr_0^2\Omega^2} \tag{1}$$

$$q = q_x = q_y = \frac{2\ \mathrm{eV}}{mr_0^2\Omega^2} \tag{2}$$

where e is the charge on an electron, U is the amplitude of the DC voltage, V is the applied zero-to-peak RF voltage, m is the mass of the ion, $r_0$ is the effective radius between rods Q1a-d, and Ω is the applied RF angular frequency. It should be noted that the parameters a and q are proportional to the DC voltage U and the RF voltage V, respectively, and that q=0.706 at the stability apex and q=0.908 at the stability boundary in the Mathieu stability diagram.

As noted above, the exemplary mass spectrometer system 100 includes one or more power supplies that is controlled by the controller 109 so as to apply electric potentials with RF, AC, and/or DC components to electrodes of the various components to configure the elements of the mass spectrometer system 100 in a coordinated fashion and/or for various different modes of operation, as discussed otherwise herein. For example, it should be noted that in addition to the mass filter mode described above with reference to equations (1) and (2), Q1 can alternatively be operated in a transmission RF-only mode in which the electrical signals are applied to the various rods of the quadrupole rod set Q1 without a DC resolving voltage. That is, the DC signal (U) is set to 0 V, such that parameter a from Eq. (1) becomes zero. Under these conditions in which a RF-only signal exhibiting a peak-to-peak amplitude ($V_{Q1}$) and angular frequency (1) is applied to the various rods Q1a-d, the mass scan line becomes horizontal such that ions entering the quadrupole rod set Q1 that are stable at and below $q_{max}$=0.908 would be selectively transmitted to Q2.

Figure 2B:
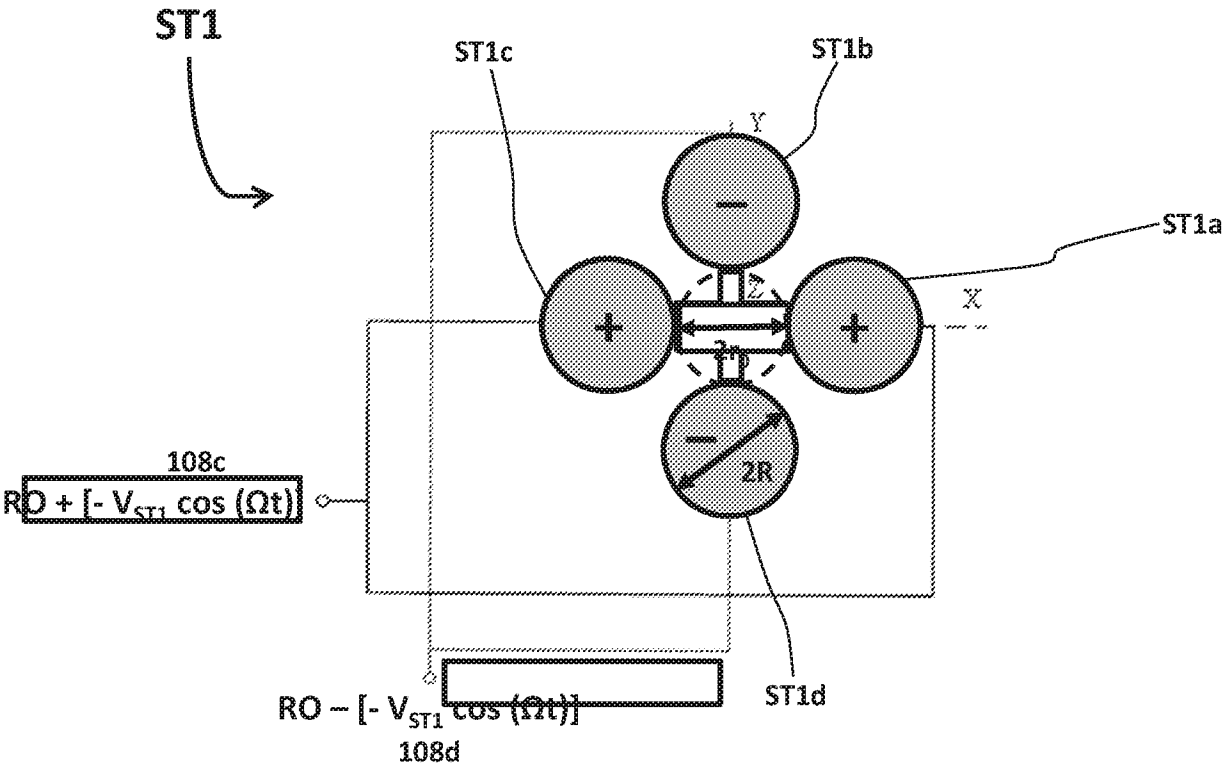
FIG. 2B is a schematic illustration of a conventional Brubaker pre-filter upstream from Q1 (designated ST1 herein) known in the art.

With reference now to FIG. 2B, a schematic illustration of pre-filter ST1 is depicted. As is conventional in the art, pre-filter ST1 depicted in FIG. 2B also consists of four parallel rod electrodes ST1a-d that are substantially similar to the rods Q1a-d except that they are generally shorter in length along the central axis (Z). Indeed, in conventional systems, the rods ST1a-d have the same cross-sectional shape and size (i.e., cylinders of radius R) and are co-linear with the rods of Q1 such that the longitudinal axis of each rod ST1a-d aligns with the longitudinal axis of the rods Q1a-d, for example, with two rods ST1b,d being disposed on the Y-axis and two rods ST1a,c being disposed on the X-axis. Similarly, the minimum distance between each of the rods ST1a-d and the central axis (Z) in conventional pre-filters is typically the same as that of Q1 ($r_0$).

Though the rods ST1a-d are electrically conductive and can also be coupled to one or more separate power supplies 108*c,d* as shown in FIG. 2B such that one or more electrical signals can be applied to each rod ST1a-d alone or in combination, the rods ST1a-d of conventional pre-filters are typically capacitively coupled to the corresponding rod Q1a-d of Q1 such that a fraction of the AC potential applied to the QMF rod (i.e., $V_Q1$) is also applied to a corresponding stubby rod ST1a-d. For purposes herein, $V_{ST1}$ represents the zero-to-peak amplitude of the AC or RF signal applied to the pre-filter ST1, Ω is the angular frequency of the AC or RF signal, and t is time. As is typical, the rods ST1a-d do not have a DC resolving voltage applied thereto as indicated by the lack of a U term. Thus, as shown in FIG. 2B, the rods ST1a-d generally comprise two pairs of rods (e.g., a first pair comprising stubby rods STla and ST1c and a second pair comprising stubby rods ST1b and ST1d), with the rods of each pair being disposed on opposed sides of the central axis (Z) and to which identical electrical signals can be applied. That is, as illustrated in FIG. 2B, the power system can comprise a power supply 108*c* electrically coupled to the first pair of rods ST1a,c so as to apply identical electric potentials thereto (i.e., $-V_{ST1}$ cos Ωt) and a power supply 108*d* electrically coupled to the second pair of rods ST1b,d for applying a different electrical signal thereto (i.e., $V_{ST1}$ cos Ωt), by way of example. In this exemplary configuration, the RF electrical signals applied to the first pair of rods ST1a,c and the second pair of rods ST1b,d are 180° out of phase with one another such that the pre-filter ST1 rod set is conventionally operated in a transmission RF-only mode that parameter a from Eq. (1) becomes zero and the pre-filter is generally effective to transmit ions to Q1 that are stable within ST1 at and below $q_{max}$=0.908.

Figure 2C:
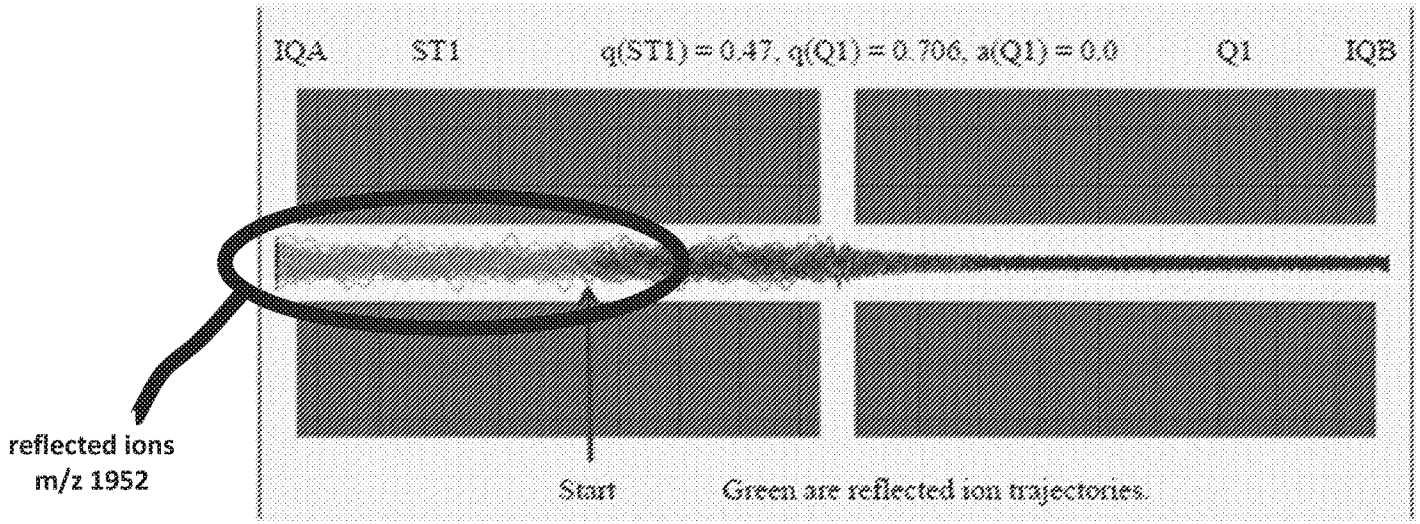
FIG. 2C is a simulation of ion trajectories as they are transmitted from ST1 of FIG. 2B to Q1 of FIG. 2A while Q1 is operating in RF-only transmission mode.

Though the conventional depiction of the combination of the pre-filter ST1 and mass filter Q1 in FIGS. 2A-B can be effective to decrease some transmission loss as ions traverse the boundary region between ST1 and Q1 by delaying the onset of the DC field, this boundary region can nonetheless cause significant reflections and trapping of the ions within the pre-filter ST1. A description of such transmission losses from a conventional ST1-Q1 boundary region will now be discussed with reference to FIGS. 2C-D, which depicts the SIMION 8.1 simulated trajectories of a plurality of ions of m/z 1952 crossing the boundary from ST1 (left) to Q1 (right). As shown, the rods of ST1 and Q1 are co-linear and are spaced such that $r_0$=4.21 mm (conventionally, the ratio $R/r_0$ is set to about 1.126 to minimize the effect of higher order non-linear terms when using cylindrical rods instead of rods with hyperbolic cross-sections). For the simulation, lens IQ1 (also referred to as IQA) is maintained at −2 V DC, the stubby rods of ST1 each have a −10 V DC applied thereto, the RO of Q1 is −1.5 V DC, and lens IQ2 (also referred to as IQB) is maintained at −2 V DC. In FIG. 2C, Q1 is being operated in RF-only transmission mode as discussed above (i.e., U=0 V such that parameter a=0.0), while in FIG. 2D a resolving DC voltage of ±U is also applied such that parameter a=0.236. In this simulation of conventional operating conditions, the RF amplitude on ST1 is 67% of the RF amplitude on Q1. Under these simulated conditions for an ion of m/z 1952, the q value for mass analyzer Q1 is 0.706 (i.e., at the apex of the stability diagram for ions of m/z 1952) and for pre-filter ST1 is 0.47 (i.e., 67% of q value of Q1 based on Eq. (2)). As shown by this simulation, there are a significant number of reflected ion trajectories for both a=0 and a≠0, that is when Q1 is operating in RF-only transmission mode and RF/DC mass-filter mode, respectively.

Moreover, simulations show that the occurrence of reflected ion trajectories increases with radial amplitude such that it is apparent that increased beam diameters will lead to more ions becoming reflected into and/or trapped in the pre-filter region due to increased space charge. As such, as ion beams of higher intensities pass through larger apertures in IQ1 into ST1, space charge effects (e.g., ion repulsion, beam spread in the radial direction) would lead to further deleterious effects (e.g., instability of the ion current, altered mass peak intensity, distortion of the transmission profile, altered peak width) as the axial field gradients present at the boundary of the pre-filter ST1 and mass filter Q1 exacerbate reflections and undesired trapping.

As noted above, it is believed that the reason for such reflections at the boundary region is due to a mismatch of the effective potentials within the quadrupoles and experienced by ions as they are transmitted between ST1 and Q1. Accordingly, in various aspects, the applicants present teachings provide methods and systems which better match the effective potentials of the adjacent quadrupoles relative to conventional systems and substantially reduce the effect of fringing fields at the boundary regions, thereby improving transmission and preventing undesirable trapping of ions within the upstream pre-filters. For example, by adjusting the amplitude of the RF signals applied to each of the rod sets relative to one another and/or by modifying the relative field strength of the rod sets (e.g., by changing the field radius of one of the quadrupoles relative to the other), the effective potential of the upstream rod set is configured to be greater than or equal to the effective potential of the downstream rod set such that the repulsive force experienced by the ions as they approach or traverse the boundary region between the quadrupoles is reduced. Moreover, preventing ions from becoming trapped in the pre-filter will produce more stable ion beams leading to more accurate multiple reaction monitoring (MRM) analysis and will allow for faster experimental duty cycles as an empty step will not be necessary for both the Q1 and Q3 pre-filters.

Systems and methods in methods in accordance with the present teachings better match the effective potential of the adjacent quadrupoles relative to conventional systems, wherein the effective potential for a quadrupole is defined as (Douglas et al., IDMS 377 (2015) 345-354):

$$V_{eff}(x, y) = \frac{eV_0^2}{m_i r_0^4 \omega^2}(x^2 + y^2) + \frac{U_0}{r_0^2}(x^2 - y^2) \tag{3}$$

where $r_0$ is the field radius of the quadrupole, $m_i$ is the mass of interest, coo is the angular drive frequency, $V_0$ is the RF amplitude, $U_0$ the resolving DC and e is the electronic charge.

When the quadrupole is operating in an RF-only transmission mode (i.e., when U=0 V, parameter a=0.0)), Eq. (3) reduces to:

$$V_{eff}(x, y) = \frac{eV_0^2}{m_i r_0^4 \omega^2}(x^2 + y^2) \tag{4}$$

Without being bound to any particular theory, applicants believe that reflections at the boundary between the quadrupoles occur when $V_{eff,Q1} > V_{eff,ST1}$, with the effective potential increasing with increasing radial distance from the longitudinal axis (Z) and increasing for both higher mass and RF amplitude. Ions travelling from ST1 to Q1 with increased radial amplitude experience an increase in the effective potential at the boundary region, which translates into a repulsive force that causes the ions to reflect towards ST1. Thus, in accordance with various aspects of the present teachings, the quadrupoles are configured to reduce reflections by configuring the combination of the upstream and downstream quadrupoles such that the effective potential of the downstream quadrupole (e.g., Q1) matches (or is less than) that of the upstream quadrupole (e.g., ST1) as follows:

$$V_{eff,Q1} \le V_{eff,ST1} \tag{5}$$

which equals:

$$\frac{eV_{0,Q1}^2}{m_i r_{0,Q1}^4 \omega^2}(x^2 + y^2) \le \frac{eV_{0,ST1}^2}{m_i r_{0,ST1}^4 \omega^2}(x^2 + y^2) \tag{6}$$

which simplifies to:

$$\frac{V_{0,Q1}^2}{r_{0,Q1}^4} \le \frac{V_{0,ST1}^2}{r_{0,ST1}^4} \tag{7}$$

Eq. (7) can be re-arranged to give:

$$r_{0,ST1} \le r_{0,Q1}\left(\frac{V_{0,ST1}}{V_{0,Q1}}\right)^{1/2} \tag{8}$$

Alternatively, Eq. (7) can be re-arranged to give:

$$V_{0,ST1} \ge V_{0,Q1}\left(\frac{r_{0,ST1}}{r_{0,Q1}}\right)^2 \tag{9}$$

Figure 2D:
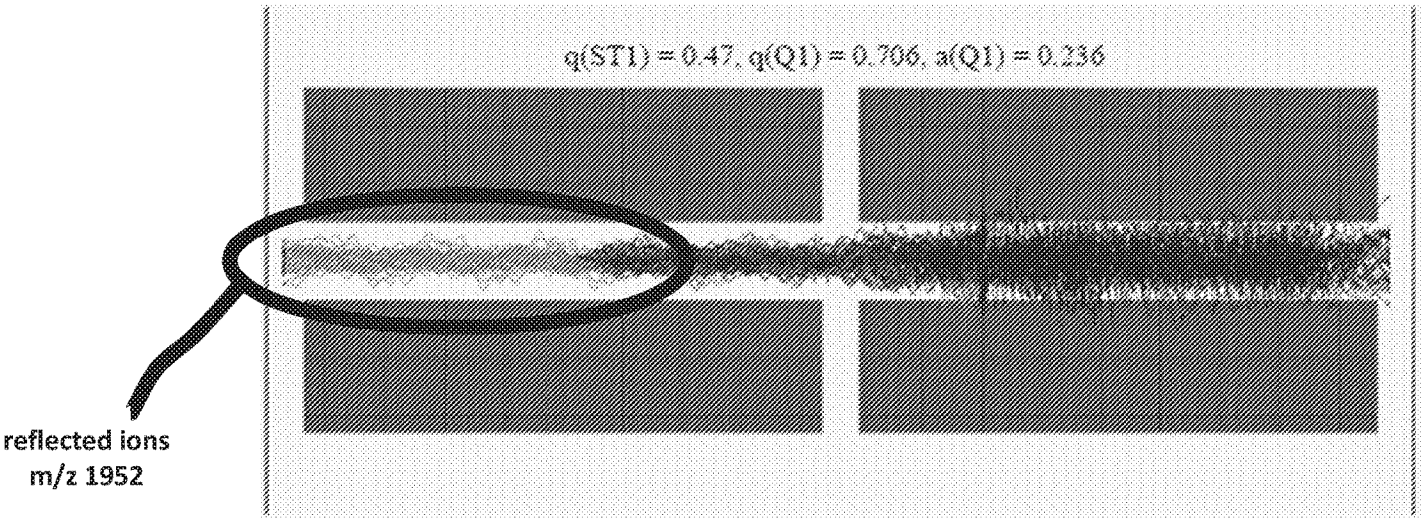
FIG. 2D is a simulation of ion trajectories as they are transmitted from ST1 of FIG. 2B to Q1 of FIG. 2A while Q1 is operating in RF/DC mass-filter mode.

The conventional configuration of pre-filter ST1 and quadrupole Q1 operating in RF-only transmission mode depicted in FIGS. 2C-D fails Eq. (9) because the RF amplitude on ST1 is 67% of the RF amplitude on Q1 ($V_{0,ST1}=0.67*V_{0,Q1}$), while the rods of ST1 and Q1 are equivalently spaced from the central axis ($r_{0,ST1}=r_{0,Q1}=4.21$ mm). It will, however, be appreciated by a person skilled in the art in light of the teachings herein that boundary regions at ST1/Q1 interfaces in accordance with the present teachings can exhibit substantially reduced reflections by adjusting the amplitude of the RF signals applied to each of the rod sets relative to one another and/or by modifying the relative field strength of the rod sets (e.g., by changing the field radius of one of the quadrupoles relative to the other) so as to alter the difference in effective potential of the quadrupoles. While practical considerations may limit modifications to conventional MS systems in view of the present teachings, Eq. (8) and Eq. (9) indicate that one could better match effective potentials when the left and right sides of the respective equations are equal by i) decreasing $r_{0,ST1}$ relative to $r_{0,Q1}$; ii) increasing $V_{0,ST1}$ relative to $V_{0,Q1}$; or iii) a combination of i) and ii). For example, the limit that $r_{0,ST1}$ can be reduced will be set by the LMCO at q=0.908, i.e., if $r_{0,ST1}$ is made too small then the new field radius and the applied RF amplitude may lead to a q>0.908 for ions of nearly any m/z such that substantially all ion trajectories become unstable within pre-filter ST1. Likewise, because ST1 is conventionally capacitively coupled to Q1 such that $V_{0,ST1}$ is less than $V_{0,Q1}$ (e.g., in FIGS. 2C-D, $V_{0,ST1}=0.67*V_{0,0}$), substantially increasing $V_{0,ST1}$ relative to $V_{0,Q1}$ in accordance with the present teachings may require that the RF signal for the stubby rods of ST1 be obtained from a different (expensive) power supply if $r_{0,ST1}=r_{0,Q1}$ as in the conventional ST1/Q1 structural configuration depicted in FIGS. 2A-B.

Figure 3B:
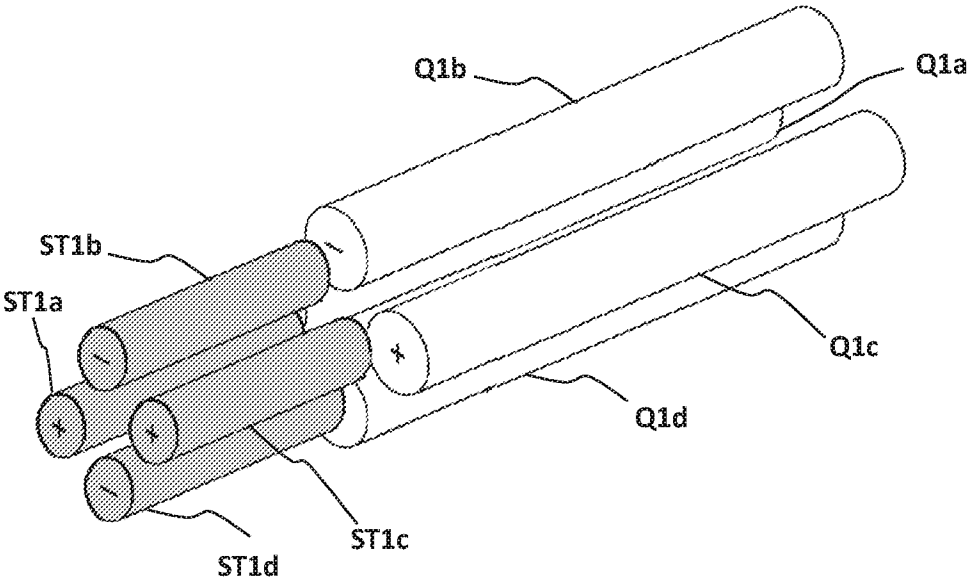
FIG. 3B is a schematic perspective illustration of the ST1/Q1 pair of FIG. 3A.
Figure 3A:
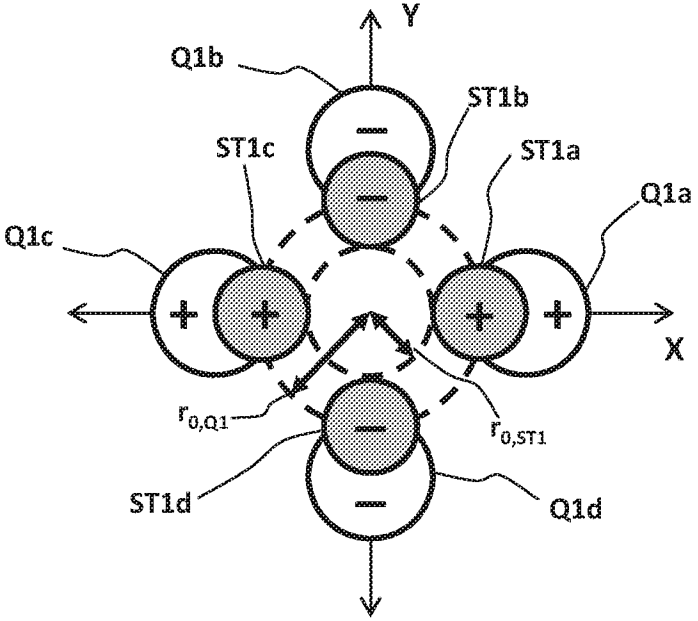
FIG. 3A is a schematic cross-sectional illustration of an exemplary ST1/Q1 pair in accordance with various aspects of the present teachings.

With reference now to FIGS. 3A-B, an exemplary configuration of pre-filter ST1 and mass filter Q1 exhibiting improved matching of the quadrupoles' effective potential in accordance with some aspects of the present teachings is schematically depicted in cross-sectional and perspective view. As shown in FIGS. 3A-B, upstream pre-filter ST1 comprises four cylindrical rod electrodes ST1a-d that are disposed about and parallel to the central axis (Z) while downstream mass filter Q1 comprises four, longer cylindrical rod electrodes that are also disposed about and parallel to the central axis (Z). As best shown in FIG. 3A, the longitudinal axis of each of the rods ST1a-d and Qla-d are disposed on the X- or Y-axis. As best shown in FIG. 3B, the boundary region is formed between the distal, downstream end of ST1 and the proximal, upstream end of Q1. Whereas conventional ST1/Q1 pairs exhibit co-linear rods of the same cross-sectional shape, size, and effective radius ($r_0$) as discussed above with reference to FIGS. 2A-B, the parallel stubby rods ST1a-d of FIGS. 3A-B together define a smaller effective radius ($r_{0,ST1}$) relative to the effective radius ($r_{0,Q1}$) of the downstream quadrupole Q1. That is, the inner surface of the rods ST1a-d are disposed closer to the central longitudinal axis (Z) than the inner surface of the rods Q1a-d, thereby modifying the relative field strength of the rod sets and ultimately increasing the effective potential of the upstream rod set ST1 relative to that of Q1 (see Eqs. (5) and (8)). In light of the teachings herein, a person skilled in the art will appreciate that effective potential matching can be achieved through a variety of configurations, though in some exemplary implementations, the field radius of the upstream rod set ST1 can be 5% less than that of Q1, 10% less than that of Q1, 20% less than that of Q1, all by way of non-limiting example. It will additionally be observed that the radius ($R_{ST1}$) of each cylindrical stubby rod ST1a-d is also reduced relative to that of the rods Q1a-d so as to maintain approximately the same ratio $R/r_0$ for the rods of each rod set, which as noted above is commonly done to minimize the effect of higher order non-linear terms for quadrupoles formed from cylindrical rods.

The rods ST1a-d are electrically conductive and can also be coupled to one or more power supplies (not shown) such that one or more electrical signals can be applied to each rod ST1a-d alone or in combination. Alternatively, the rods ST1a-d can be capacitively coupled to the corresponding rod Q1a-d such that a fraction of the AC potential applied to the Q1 rod would also be applied to corresponding stubby rod ST1a-d. As is convention and suggested by the plus or minus on each rod, the AC signal applied to each rod is 180° out of phase with its adjacent rods within the same set such that each rod set comprises two pairs of rods disposed on opposite sides of the central axis to which identical signals are applied. For example, rods ST1a,c form a first pair of stubby rods and rods ST1b,d form a second pair within ST1, while rods Q1a,c form a first pair and rods Q1b,d form a second pair within Q1. It will also be observed that the rods ST1a,c/Q1a,c on the X-axis exhibit the same phase as one another, while the rods ST1b,d/Q1b,d on the Y-axis exhibit the same phase as one another (which is opposite from that of the rods on the X-axis). Moreover, as with the conventional mass filter Q1 shown in FIG. 2A, the power system for FIGS. 3A-B can apply an electric potential to rods Q1a,c of $RO+[U-V_{Q1}\cos\Omega t]$ and an electric potential to rods Q1b,d of $RO+[U-V_{Q1}\cos\Omega t]$ while Q1 is operating in mass-filter mode. Of course, in addition to this mode in which U>0 V DC (i.e., parameter a 0), Q1 can alternatively be operated in RF-only transmission mode in which the electrical signals applied to the rods of Q1 do not include a DC resolving voltage (i.e., parameter a from Eq. (1) becomes zero). Finally, though rods ST1a-d may all be maintained at a given rod offset (e.g., RO=−10 V DC in the simulation of FIGS. 2C-D), there is no resolving DC voltage applied to the stubby rods ST1a-d (i.e., U=0 V DC). As discussed above and suggested by Eq. (4), the effective potential of ST1 can additionally or alternatively be increased relative to that of Q1 by increasing the amplitude of the RF signal applied to ST1 ($V_{0,ST1}$) relative to that applied to Q1 ($V_{0,Q1}$).

Figure 3C:
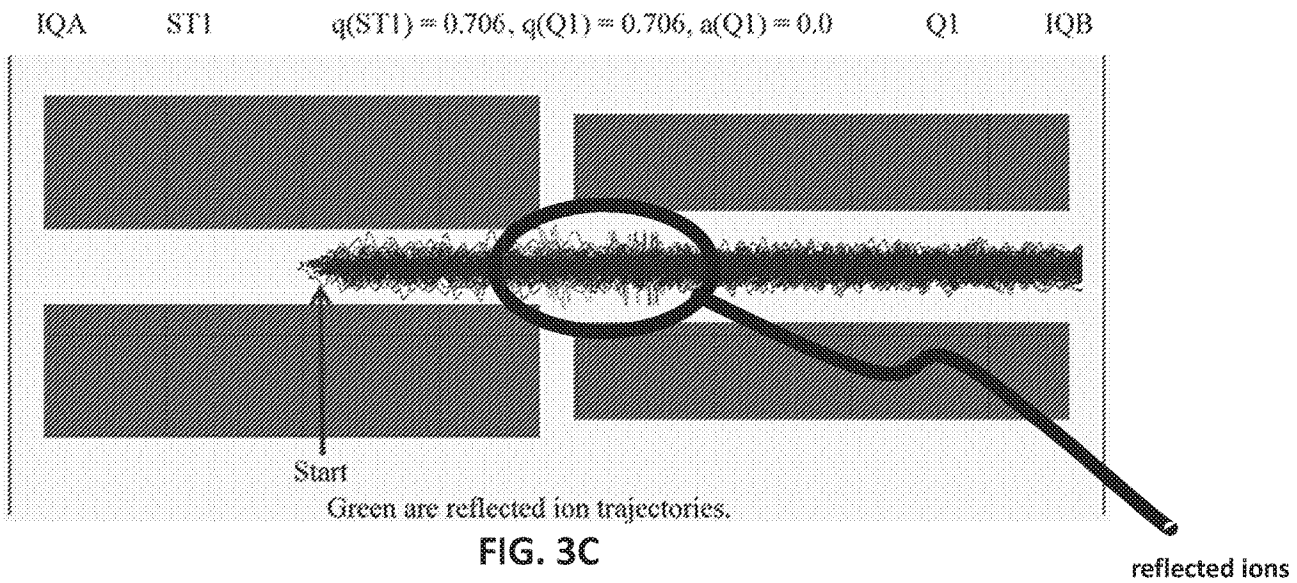
FIG. 3C is a simulation of ion trajectories as they are transmitted through the boundary region between ST1/Q1 of FIGS. 3A-B while Q1 is operating in RF-only transmission mode.

The reduction in reflections at the boundary region within the exemplary ST1/Q1 pair of FIGS. 3A-B relative to the conventional system depicted in FIGS. 2A-C is demonstrated in FIG. 3C. FIG. 3C depicts the SIMION 8.1 simulated trajectories of a plurality of ions of m/z 1952 crossing the boundary from ST1 (left) to Q1 (right). The rods ST1a-d in FIG. 3C, however, are spaced such that field radius of ST1 is reduced ($r_{0,ST1}$=3.51 mm versus 4.21 mm in FIG. 2C) relative to that of Q1 ($r_{0,Q1}$=4.21 mm as in the simulation of FIG. 2C). As with the earlier simulation, the simulation for FIG. 3C maintains lens IQA at −2 V DC, the stubby rods of ST1 at −10 V DC, the RO of Q1 at −1.5 V DC, and lens IQB at −2 V DC. In FIG. 3C, Q1 is being operated in RF-only transmission mode as discussed above (i.e., U=0 V DC, parameter a=0.0), with the RF amplitude on ST1 being increased to 69.5% of the RF amplitude on Q1 (in FIG. 2C, $V_{0,ST1}=0.67*V_{0,Q1}$). Under these simulated conditions for an ion of m/z 1952, the q value for both the pre-filter ST1 and mass analyzer Q1 is 0.706. This is an increase in the q value for ST1 from 0.47 in FIG. 2C due to the relative increase in $V_{0,ST1}$ and relative decrease in $r_{0,ST1}$, as suggested by Eq. (2). It will be appreciated that under the conditions of FIG. 3C, the effective potentials of ST1 and Q1 are matched in that the left and right sides of Eq. (8) are substantially equal: 3.51 mm 4.21 mm*(0.695)½. In comparing FIGS. 2C and 3C, when a=0 and the effective potentials are matched, the number of reflected ion trajectories is substantially reduced (indeed, nearly eliminated) relative to the conventional operating configuration utilized in the simulation of FIG. 2C.

Figure 3D:
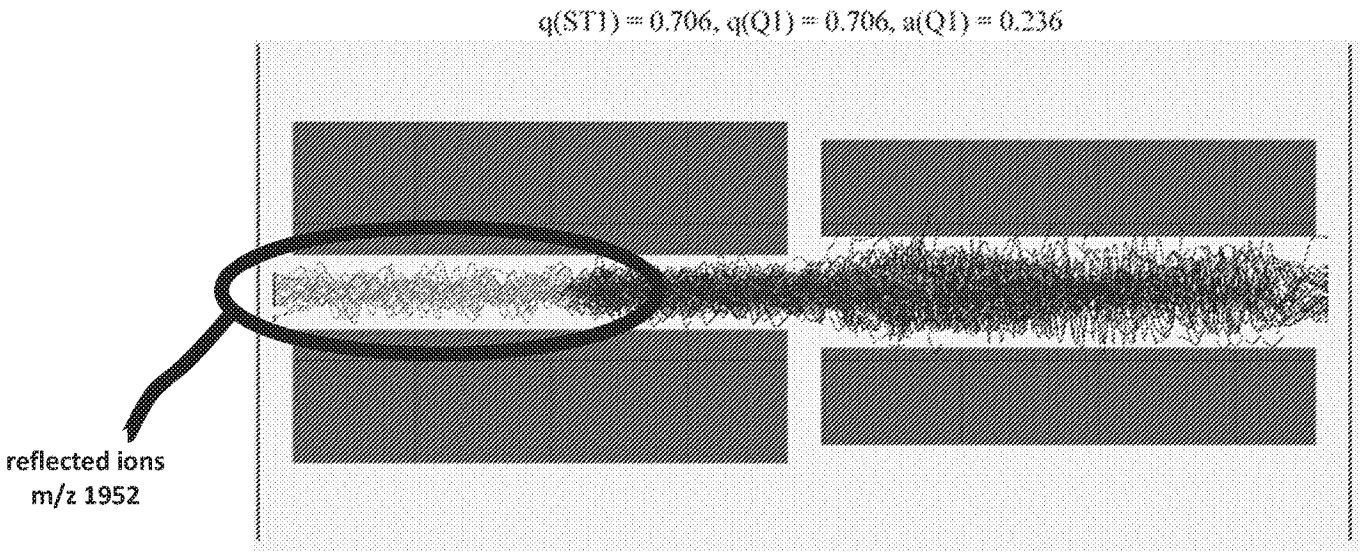
FIG. 3D is a simulation of ion trajectories as they are transmitted through the boundary region between ST1/Q1 of FIGS. 3A-B while Q1 is operating in RF/DC mass-filter mode.

The same simulation as FIG. 3C was performed to generate FIG. 3D, except with Q1 being operated in RF/DC mass-filter mode by applying a resolving DC voltage of ±U to the rods Q1a-d such that parameter a=0.236 (see Eq. (1)) as is known in the art. It will be observed by comparing FIGS. 3C and 3D that application of the resolving DC voltage modifies the fringing fields such that substantial reflections again occur despite the significant reduction exhibited between FIGS. 2C and 3C when parameter a=0. However, in the case where parameter a>0, applicants have discovered that relative rotation between the ST1 and Q1 rod sets about the X-Y plane can be effective to alleviate reflections and/or trapping of ions within ST1 that occurs when Q1 is switched to operate in RF/DC mass-filter mode.

Figure 4B:
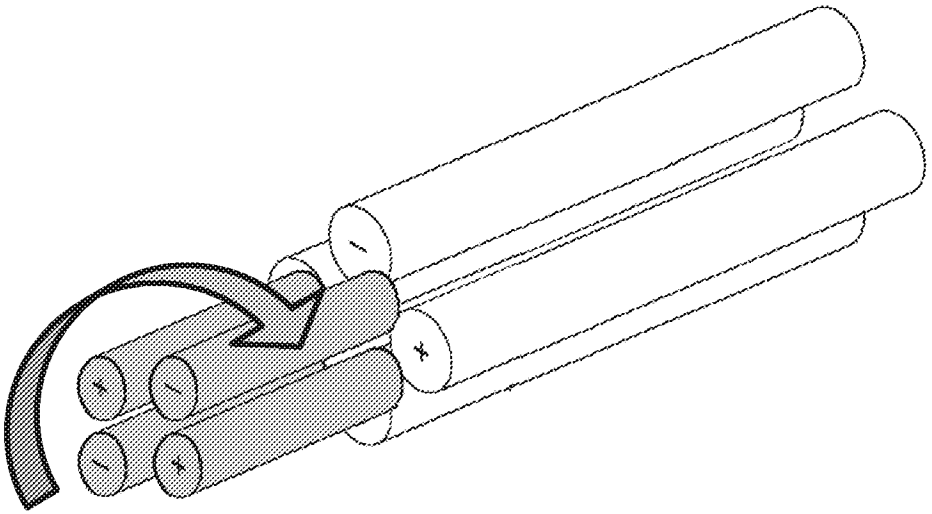
FIG. 4B is a schematic perspective illustration of the ST1/Q1 pair of FIG. 4A.
Figure 4A:
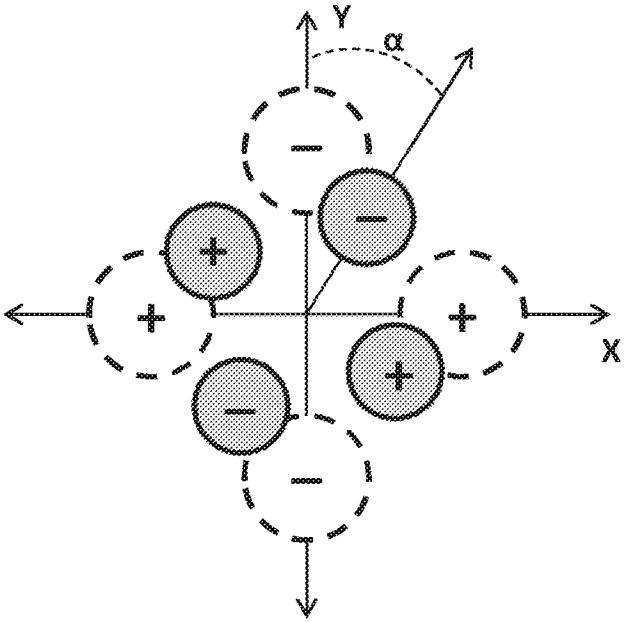
FIG. 4A is a schematic cross-sectional illustration of another exemplary ST1/Q1 pair in accordance with various aspects of the present teachings.

With reference now to FIGS. 4A-B, another exemplary configuration of ST1 and Q1 in accordance with the present teachings is depicted. As shown, the ST1/Q1 rod sets are identical to those depicted in FIGS. 3A-B except that the rod set ST1 has been rotated by an angle of a in the X-Y plane about the central axis (Z) such that the longitudinal axis of each of the rods ST1a-d are no longer on the X- or Y-axis. Again, the rods ST1a-d and Q1a-d are electrically conductive and can also be coupled to one or more power supplies (not shown) such that one or more electrical signals can be applied to each rod ST1a-d alone or in combination as discussed above with reference to FIGS. 3A-B.

Figure 4C:
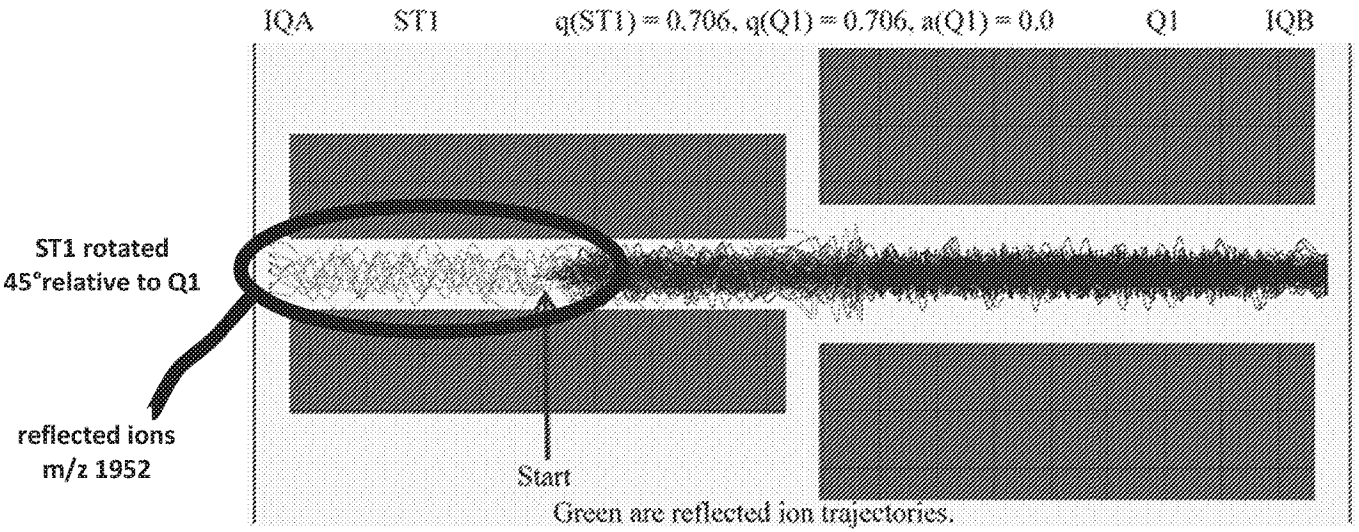
FIG. 4C is a simulation of ion trajectories as they are transmitted through the boundary region between ST1/Q1 of FIGS. 4A-B while Q1 is operating in RF-only transmission mode.
Figure 4D:
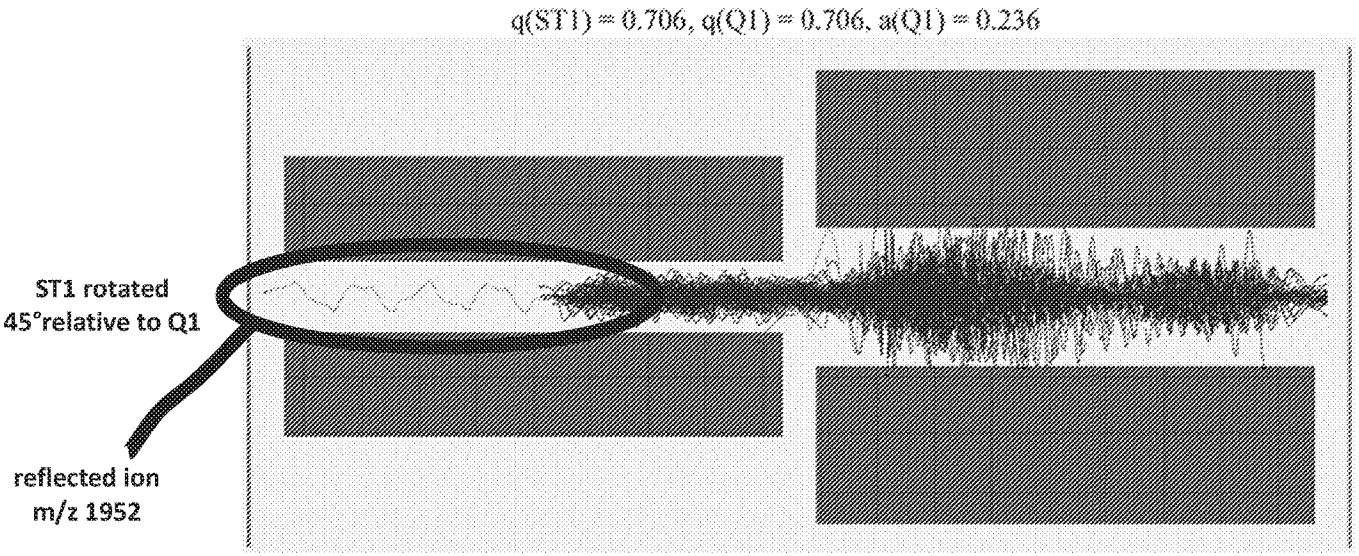
FIG. 4D is a simulation of ion trajectories as they are transmitted through the boundary region between ST1/Q1 of FIGS. 4A-B while Q1 is operating in RF/DC mass-filter mode.

The effect of the boundary region on ion transmission within the exemplary ST1/Q1 pair of FIGS. 4A-B relative to the conventional system of FIGS. 2A-D and the exemplary non-rotated embodiment of FIGS. 3A-D is demonstrated in FIGS. 4C-F. With reference first to FIG. 4C, the SIMION 8.1 simulated trajectories of a plurality of ions of m/z 1952 crossing the boundary from ST1 (left) to Q1 (right) are depicted under similar conditions as FIG. 3C. However, in FIG. 4C, the pre-filter ST1 has been rotated 45° about the central longitudinal axis of ST1 and Q1 and the rods ST1a-d are spaced such that field radius ($r_{0,ST1}$) is 3.495 mm (i.e., slightly less than the 3.51 mm of FIG. 3C), which is less than that of Q1 ($r_{0,Q1}$=4.21 mm in FIGS. 2C, 3C, and 4C). The lens and rod DC offsets are identical in FIGS. 2C, 3C, and 4C. In FIG. 4C, Q1 is being operated in RF-only transmission mode as discussed above (i.e., U=0 V DC, parameter a=0.0), with the RF amplitude on ST1 being increased to 68.9% of the RF amplitude on Q1 (in FIG. 2C, $V_{0,ST1}=0.67*V_{0,Q1}$; in FIG. 3C, $V_{0,ST1}=0.695*V_{0,Q1}$). It will be noted that although the ST1 field radii and ST1 RF amplitudes differ between FIGS. 3C and 4C, the q values for both the pre-filter ST1 and mass analyzer Q1 are 0.706 for an ion of m/z 1952 according to Eq. (2). Likewise, the decrease in $V_{0,ST1}$ relative to FIG. 3C and increase in $r_{0,ST1}$ relative to FIG. 3C result in matched effective potentials in that the left and right sides of Eq. (8) remain substantially equal: 3.495 mm 4.21 mm*(0.689)½. In comparing FIGS. 2C, 3C, and 4C in RF-only transmission mode, it is observed that the number of reflected ion trajectories is substantially reduced in FIGS. 3C and 4C, that is, when the effective ST1/Q1 potentials are matched relative to the conventional operating configuration utilized in the simulation of FIG. 2C. Though there are more ions reflected in the rotated ST1 embodiment of FIG. 4C relative to the non-rotated ST1 embodiment of FIG. 3C, ST1 of FIG. 4C still exhibits a significant reduction in reflected ions compared to the conventional system exemplified in FIG. 2C. However, a shown in FIG. 4D, upon applying a resolving DC voltage of ±U to the rods Q1a-d such that Q1 of FIG. 4C is being operated in RF/DC mass-filter (parameter a=0.236), only a single simulated ion is depicted as being reflected at the boundary region. That is, in comparing FIGS. 2D, 3D, and 4D, FIG. 4D exhibits significantly less reflections where parameter a>0. Without being bound by any particular theory, it is believed that the radial component of the fringing DC fields resulting from the relative rotation of ST1 causes ions that are reflected to go into unstable ion trajectories and neutralized within ST1, thereby preventing interference with subsequent ion transmission.

Figure 4E:
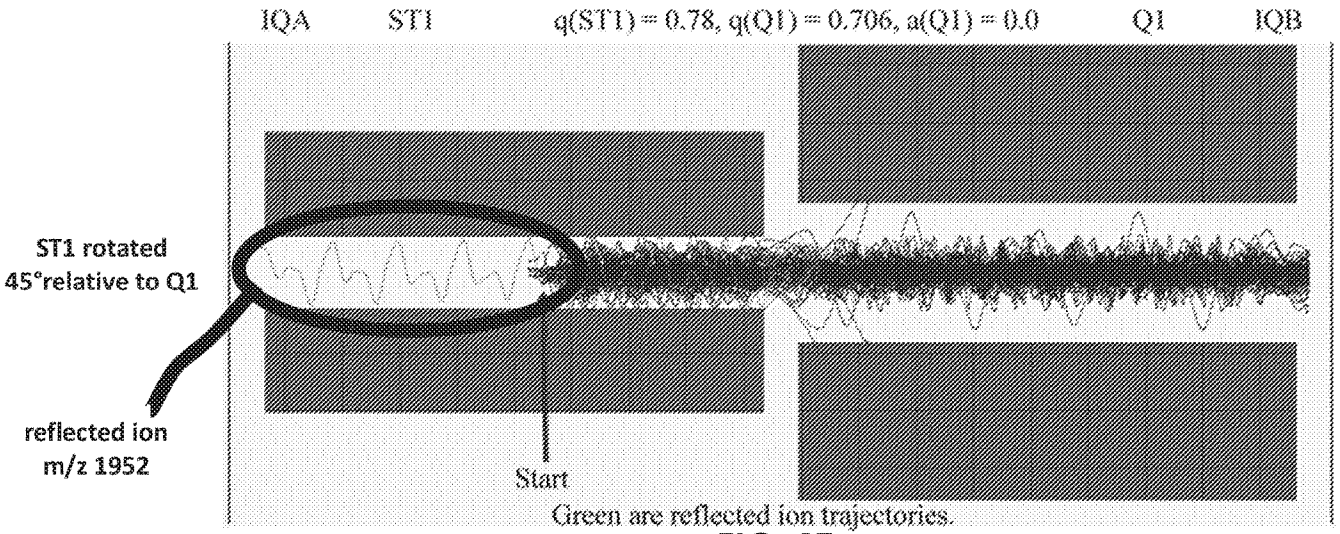
FIG. 4E is another simulation of ion trajectories as they are transmitted through the boundary region between ST1/Q1 of FIGS. 4A-B while Q1 is operating in RF-only transmission mode under different operating conditions than in FIG. 4C.

As noted above with respect to Eqs. (8) and (9), the effective potential of ST1 can be set to a value equal to or greater than that of Q1 in accordance with various aspects of the present teachings by modifying the relative field strength of the rod sets (e.g., by decreasing the field radius of ST1 relative to that of Q1) and/or by increasing the amplitude of the RF signal applied to ST1 ($V_{0,ST1}$) relative to that applied to Q1 ($V_{0,0}$). Though the simulations presented in FIGS. 3C-D and 4C-D match the effective potentials of rod sets ST1 and Q1 (i.e., $V_{eff,Q1} \approx V_{eff,ST1}$), it will be appreciated that the present teachings contemplate further increases in the effective potential of the upstream set ST1 to a value greater than that of Q1. For example, with reference now to FIG. 4E-F, the effect of the boundary region on ion transmission with $V_{eff,Q1} < V_{eff,ST1}$ is demonstrated. With reference first to FIG. 4E, the SIMION 8.1 simulated trajectories of a plurality of ions of m/z 1952 crossing the boundary from ST1 (left) to Q1 (right) are depicted under identical conditions as FIG. 4C except that the RF amplitude on ST1 is increased to 75.9% of the RF amplitude on Q1 (whereas in FIG. 4C $V_{0,ST1}=0.689*V_{0,0}$). According to Eq. (2), the q values for pre-filter ST1 therefore increases to 0.78, while for mass filter Q1 it remains at 0.706 Likewise, the relative increase in $V_{0,ST1}$ compared to FIG. 4C results in the field radius ($r_{0,ST1}$) on the left side of Eq. (8) being less than the right side: 3.495 mm<4.21 mm*(0.759)½, thus satisfying Eq, (5) in that $V_{eff,Q1} < V_{eff,ST1}$. In comparing FIGS. 2C, 3C, 4C, and 4E (RF-only transmission mode), it is observed that, in this exemplary configuration of FIG. 4E in which the effective potential of Q1 is less than that of ST1, the number of reflected ion trajectories is substantially reduced (indeed, nearly eliminated) in that only a single ion is shown as being reflected. In particular, the further increase in the effective potential of ST1 (by increasing $V_{0,ST1}$ relative to $V_{0,Q1}$) removes many of the reflections that are seen in FIG. 4C in the case of a=0. Moreover, when a resolving DC voltage is added such that parameter a=0.236, no reflected ions can be seen in the simulation of FIG. 4F.

Though the simulations of FIGS. 4C-4F demonstrate the effect of adjusting the relative effective potential of ST1 and Q1 at a single ST1 rotation angle α of 45°, systems and methods in accordance with various aspects of the present teachings can exhibit a range of relative rotation angles between adjacent quadrupoles. Indeed, applicants have found that a rotation angle in a range from about 25° to about 45° provides particularly improved results both when Q1 is operated in RF-only transmission mode (i.e., parameter a=0) and RF/DC mass-filter mode (i.e., parameter a≠0). With reference to FIG. 5A, a plot is provided of transmitted and reflected ions at various rotation angles of ST1, otherwise operating under the conditions of the simulation of FIG. 4E in which Q1 is in RF-only transmission mode (e.g., $r_{0,ST1}$=3.495 mm; $r_{0,Q1}$=4.21 mm; $V_{0,ST1}=0.759*V_{0,Q1}$; $q_{ST1}$=0.78, $q_{Q1}$=0.706, a=0.0). As can be seen in FIG. 5A, for rotation angles between 0° and about 45°, nearly 100% of ions of m/z 1952 are transmitted (solid shapes) from ST1 into Q1 (and out of the downstream end of Q1, toward Q2) regardless of their initial displacement from the central axis as they enter ST1 (circles=0.1 mm initial displacement; triangles=0.2 mm; squares=0.3 mm). Alternatively, there are almost no reflected ions (open shapes) regardless of initial displacement up to about 45°. At angles greater than about 45°, FIG. 5A shows that the number of transmitted ions decreases from about 100% to about 50% at a rotation angle of about 90°, with transmission of ions having larger initial displacement being affected at earlier rotation angles and to a greater degree. Similarly, as the rotation angle increases from 45° to 90°, the fraction of ions reflected generally increases. It is noted that the total percentage of transmitted and reflected ions for any rotation angle may not add up to 100%, for example, as a result of ions being neutralized within Q1.

Figure 4F:
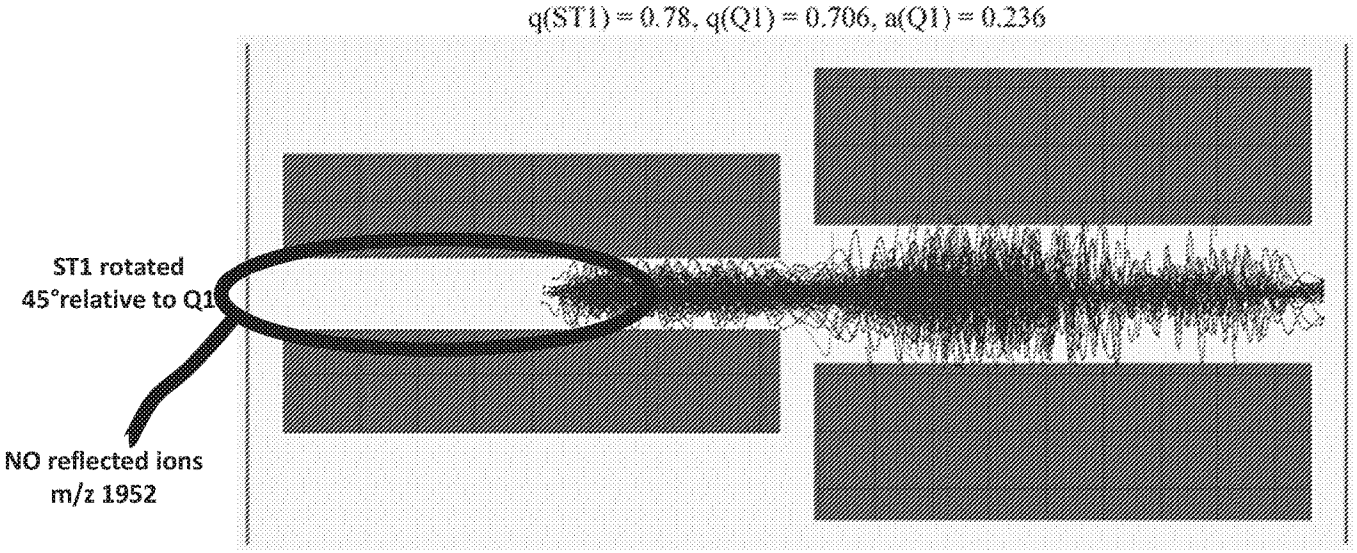
FIG. 4F is another simulation of ion trajectories as they are transmitted through the boundary region between ST1/Q1 of FIGS. 4A-B while Q1 is operating in RF/DC mass-filter mode under different operating conditions than in FIG. 4D.
Figure 5A:
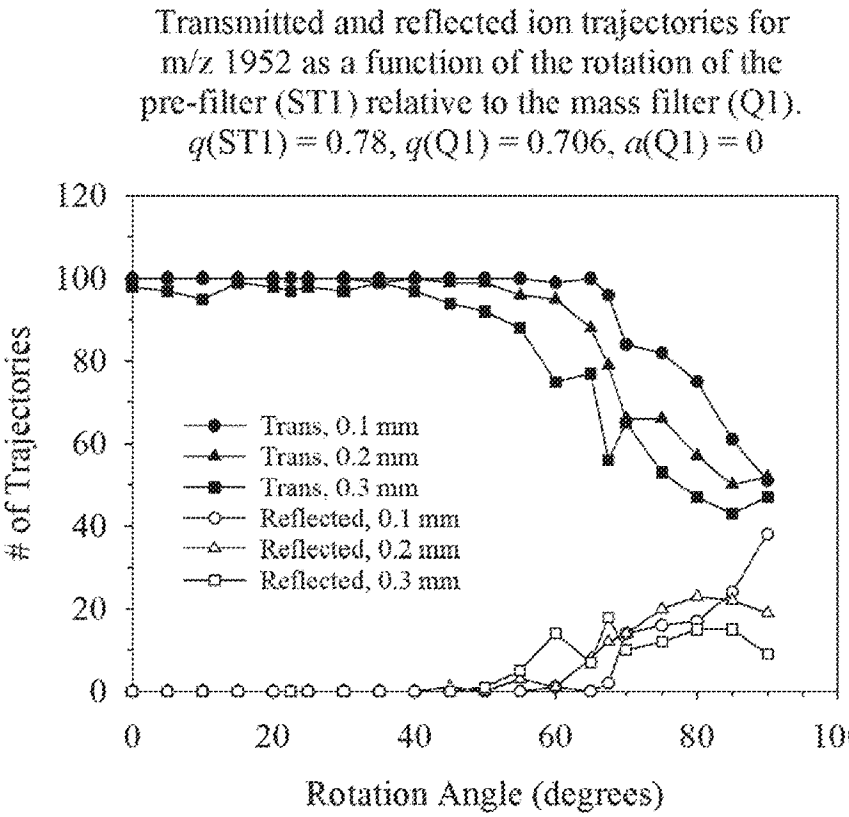
FIG. 5A is a plot of transmitted and reflected ions at various rotation angles of ST1 under the simulation conditions of FIG. 4E.
Figure 5B:
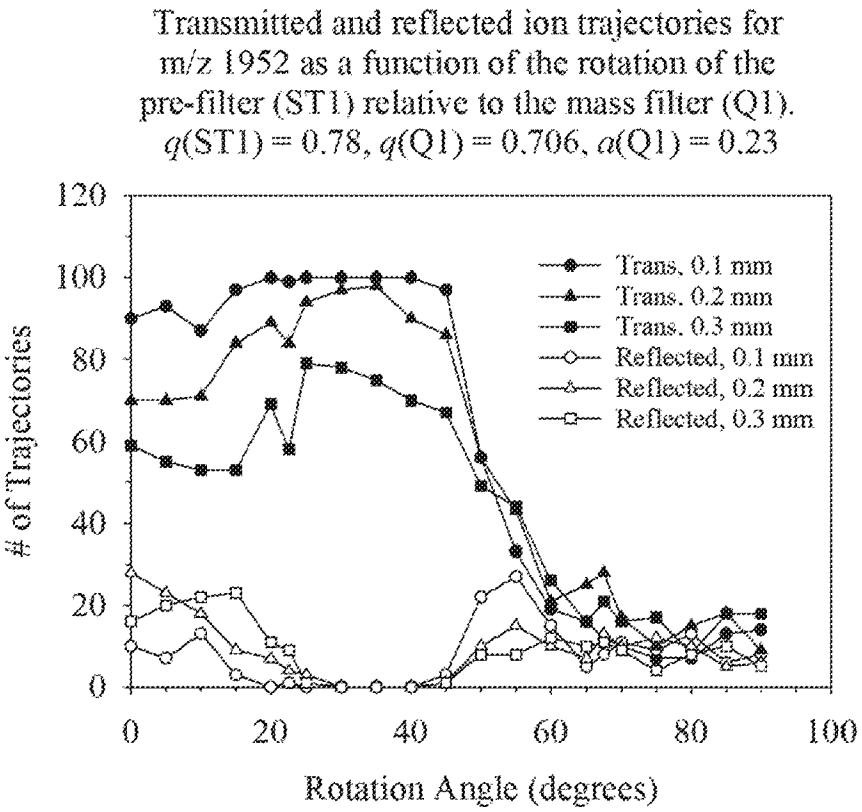
FIG. 5B is a plot of transmitted and reflected ions at various rotation angles of ST1 under the simulation conditions of FIG. 4F.

On the other hand, FIG. 5B depicts a plot of transmitted ions (closed circles) and reflected ions (open circles) at rotation angles of ST1 ranging from 0° to 90°, but otherwise operating under the conditions of the simulation of FIG. 4F in which Q1 is operated in RF/DC mass-filter mode (e.g., $r_{0,ST1}$=3.495 mm; $r_{0,Q1}$=4.21 mm; $V_{0,ST1}=0.759*V_{0,Q1}$; $q_{ST1}$=0.78, $q_{Q1}$=0.706, a=0.236). As shown, larger initial displacements of the ions (circles=0.1 mm; triangles=0.2 mm; squares=0.3 mm) reduces the transmission through Q1 (toward Q2), with about 60% of ions at an initial displacement of 0.3 mm being transmitted at 0° rotation, about 70% of ions at an initial displacement of 0.2 mm being transmitted at 0° rotation, and about 90% of ions at an initial displacement of 0.1 mm being transmitted at 0° rotation. The percentage of ions that are transmitted from each initial displacement remains substantially constant (or increases slightly) for angles up to about 45°, quickly decreases, and then remains at about 10-20% for angles greater than about 60°. As shown by the open circles, triangles, and squares of FIG. 5B, about 15-30% of ions are reflected at 0° depending on initial displacement, which decreases to about 0% at angles between 25° and 45°, and the rises again to about 10% for angles greater than 45°. Together, these plots indicate that an angle of relative rotation in a range from about 25° to about 45° maximizes transmission while minimizing reflections for both exemplary operation modes for ST1/Q1: i) ST1 in RF-only transmission mode and Q1 in RF-only transmission mode and ii) ST1 in RF-only transmission mode and Q1 in RF/DC mass-filter mode.

Figure 6A:
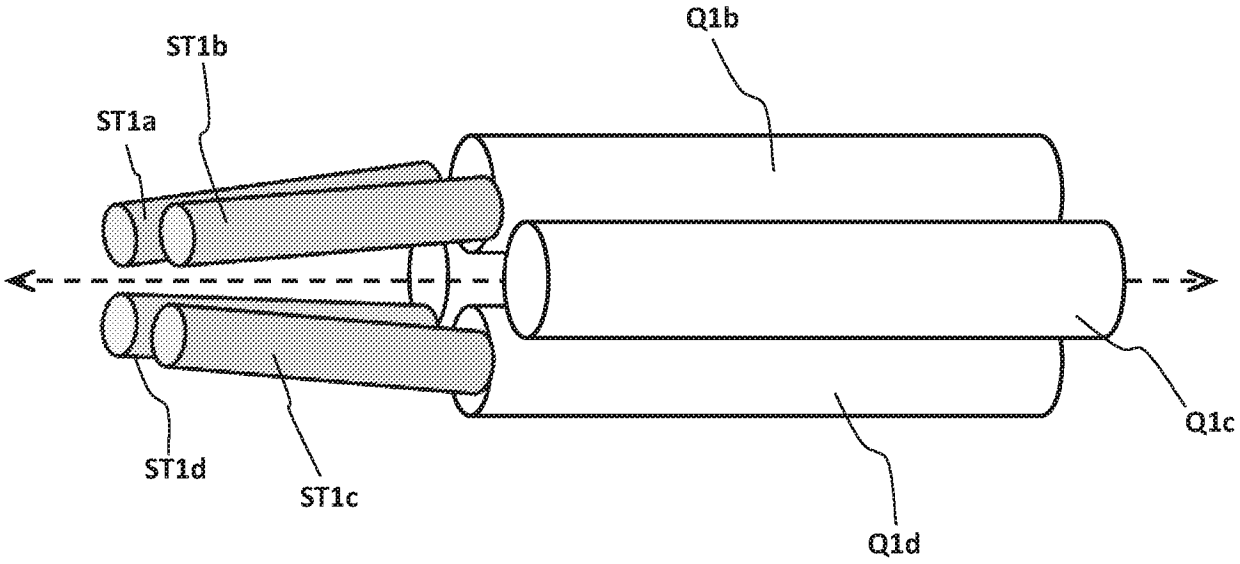
FIG. 6A is a schematic perspective illustration of another exemplary ST1/Q1 pair in accordance with various aspects of the present teachings.

Though the simulations above demonstrate that the combination of pre-filters ST1 and mass filters Q1 in accordance with the present teachings significantly reduce (and in some implementations nearly eliminate) the occurrence of reflections at the boundary region relative to conventional ST1/Q1 configurations, applicants have additionally discovered that some reflected ions can nonetheless become trapped within pre-filter ST1 based on observations in the transmission profile through its ST1/Q1 combinations with and without a step of emptying ST1 as discussed below with reference to FIGS. 7-10. In accordance with further aspects of the present teachings, applicants have additionally discovered that the configuration of the ST1 rods can be further adjusted such that ions reflected at the boundary region either tend to be neutralized within ST1 (instead of being trapped therein) and/or fail to substantially effect the transmission of subsequent ions therethrough. Indeed, as noted above, it may be preferable that reflected ions are eliminated as space charge effects caused by increasing concentrations of ions trapped within ST1 can lead to further deleterious effects (e.g., instability of the ion current, altered mass peak intensity, distortion of the transmission profile). In particular, it is believed that an axial gradient in the effective potential of ST1 directed toward the downstream elements encourages any ions that are reflected at the boundary region to be redirected back toward Q1 and to be lost in the fringing fields. Alternatively, without being bound by any particular theory, an axial gradient in the effective potential of ST1 directed toward the upstream end of ST1 may encourage any ions that are reflected at the boundary region to be concentrated at the upstream end of ST1 (e.g., adjacent IQ1) such that ions traversing therethrough can stabilize prior to reaching the boundary region between ST1/Q1. Exemplary implementations in light of this additional discovery will now be described with reference to FIGS. 6A-B, in which a non-parallel configuration of the rods ST1a-d substantially reduces the occurrence of any reflected ions from affecting ion beam stability. With reference first to FIG. 6A, stubby rod set ST1 and mass filter Q1 are similar to those depicted in FIGS. 4A-B (e.g., average $r_{0,ST1}<r_{0,Q1}$, ST1 is rotated about the central longitudinal axis by 45° relative to Q1), but differ in that the central axis of rods ST1a-d are not parallel to the longitudinal axis (Z) of ST1/Q1 such that the effective potential varies along ST1's length. Rather, each of rods ST1a-d are flared away from the central longitudinal axis (Z) such that the field radius at the entrance end of ST1 is smaller than the field radius at the exit end of ST1. In other words, according to Eq. (4), the field at the entrance of ST1 is greater than at the exit, thereby creating an axial gradient along ST1's length directed toward the downstream elements. In such implementations, the q values at the entrance and the exit of the pre-filter are defined as follows:

$$q_{entrance} = \frac{A_2 4\ \text{eV}}{m r_{0,entrance}^2 \Omega^2} \tag{10}$$

and $$q_{exit} = \frac{A_2 4\ \text{eV}}{m r_{0,exit}^2 \Omega^2} \tag{11}$$

which when combined lead to $$r_{0,exit} = r_{0,entrance}\left(\frac{q_{entrance}}{q_{exit}}\right)^{1/2} \tag{12}$$

where A2 takes into account the multipole contribution of the quadrupolar field in light of the difference between circular and hyberbolic-shaped electrodes.

As noted above, if $r_{0,entrance}$ is made too small such that the field radius and applied RF amplitude lead to a q>0.908 for ions of nearly any m/z, substantially all ion trajectories may become unstable within pre-filter ST1. Accordingly, in particular implementations in accordance with the present teachings, it may be preferable to select the field radii and $\Delta r_{0,ST1}$ such that the maximum q value at the entrance of the pre-filter ST1 is 0.908 and the minimum q value at the exit of the pre-filter ST1 is 0.706. In such embodiments, the effective potential's axial gradient in ST1 directed toward the downstream elements may encourage any ions that are reflected at the boundary region back toward Q1 and ultimately swept away by the fringing fields.

Figure 6B:
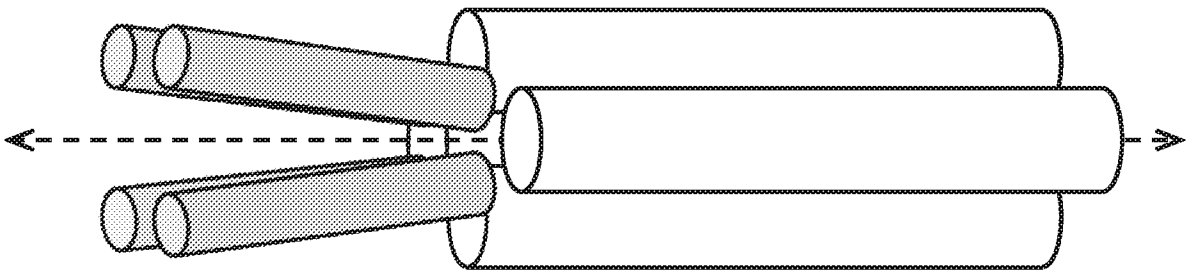
FIG. 6B is a schematic perspective illustration of another exemplary ST1/Q1 pair in accordance with various aspects of the present teachings.

With reference now to FIG. 6B, stubby rod set ST1 and mass filter Q1 are similar to those depicted in FIGS. 6A-B (e.g., average $r_{0,ST1}<r_{0,Q1}$, ST1 is rotated about the central longitudinal axis by 45° relative to Q1, but differ in that the $r_{0,ST1,entrance}<r_{0,ST1,exit}$. As such, the field radius at the exit end of ST1 is smaller than the field radius at the entrance end of ST1, thereby generating an axial gradient in ST1 toward the upstream end. As noted above, it is believed that such an axial gradient may encourage any ions that are reflected at the boundary region to be concentrated at the upstream end of ST1 (e.g., adjacent IQ1) such that the trajectory of subsequent ions traversing through trapped ions at the front end of ST1 stabilizes prior to reaching the boundary region between ST1/Q1.

The applicant's teachings can be even more fully understood with reference to the following data presented in FIGS. 7-10, which are provided to demonstrate but not limit the present teachings. As described below, the plots demonstrate exemplary improvements with respect to ion beam stability and accurate mass peak intensity and peak width for methods and systems in accordance with various aspects of the present teachings relative to conventional ST1/Q1 configurations known in the art. Plots 7A, 8A, 9A, and 10A were carried out with a QTrap 6500+ (marketed by SCIEX) utilizing a conventional ST1/Q1 configuration as discussed above with respect to FIGS. 2A-B (e.g., $r_{0,ST1}=r_{0,Q1}=4.17$ mm; $q_{ST1}=0.47$, $q_{Q1}=0.706$, rods of ST1 are coaxial with rods of Q1). Plots 7B, 8B, 9B, and 10B were generated with a modified QTrap 6500+ having the ST1/Q1 configuration discussed above with respect to FIG. 6A (e.g., $r_{0,ST1,average}=3.52$; $r_{0,ST1,entrance}=3.42$; $r_{0,ST1,exit}=3.62$; $r_{0,Q1}=4.17$ mm; $q_{ST1,entrance}=0.85$; $q_{ST1,exit}=0.76$, $q_{Q1}=0.706$, ST1 is rotated 45° relative to Q1). The experimental ion is m/z 791, and the RF signal for ST1 and Q1 was at 940 kHz, with the amplitude of the RF signal being selected to achieve the above q values. The empty steps were accomplished by dropping Q1 down to m/z 10 over 0.2 Da or 31 ms (30 ms scan time plus 1 ms pause time) so as to allow any ions that were trapped in the pre-filter to disperse radially. Ions were introduced into the vacuum through a 0.72 mm diameter sampling orifice into the dual QJet ion optic (2.6 Torr) and then through the IQO aperture in the Q0 ion optic stage (6 mTorr). The ions then pass through the IQ1 aperture into the high vacuum stage (8e-6 Torr). After passing through the IQ1 aperture, the ions were transmitted through a pre-filter (ST1), a mass filter (Q1), a post filter (ST2) and into the 180° curved collision cell (Q2). Upon exiting the collision cell ions pass through another pre-filter (ST3) and into a second mass filter (Q3). The ions are then detected as they exit the mass filter and pass through an exit lens using an HED/Magnum 5907 detection system.

Figure 7A:
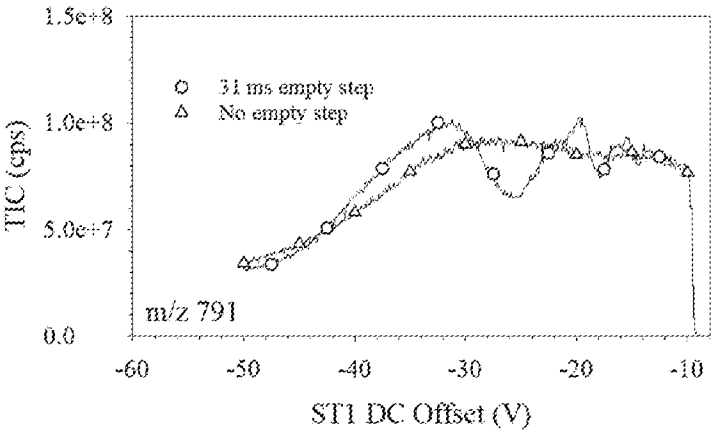
FIG. 7A depicts total ion current as a function of ST1 offset voltage for ions of m/z 791 through a conventional ST1/Q1 as depicted in FIGS. 2A-B.

With specific reference now to FIG. 7A, the total ion current (TIC) is depicted for a conventional configuration as shown in FIGS. 2A-B as the ST1 DC offset voltage is scanned from −50 V DC to −8 V DC, with and without an empty step (indicated by a circle and triangle, respectively). As shown, the empty step has a significant impact on the depicted transmission profiles, thereby indicating the presence of trapped ions within ST1. However, in FIG. 7B in which the modified ST1/Q1 configuration described above (schematically shown in FIG. 6A), it was observed that there was virtually no difference in the transmission profiles, with and without an empty step.

Figure 7B:
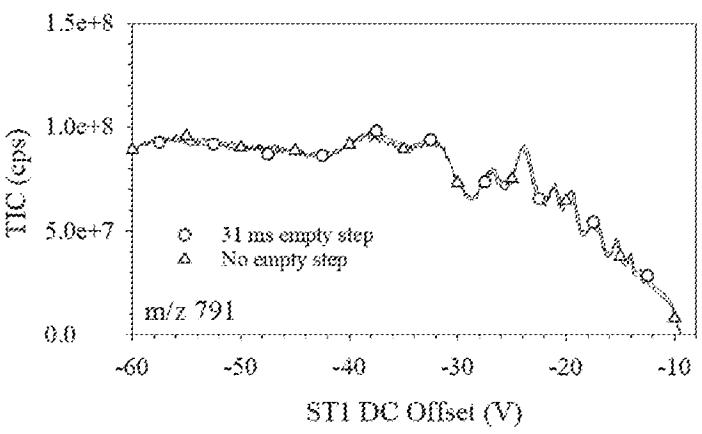
FIG. 7B depicts total ion current as a function of ST1 offset voltage for ions of m/z 791 through ST1/Q1 as schematically depicted in FIG. 6A in accordance with various aspects of the present teachings.
Figure 8A:
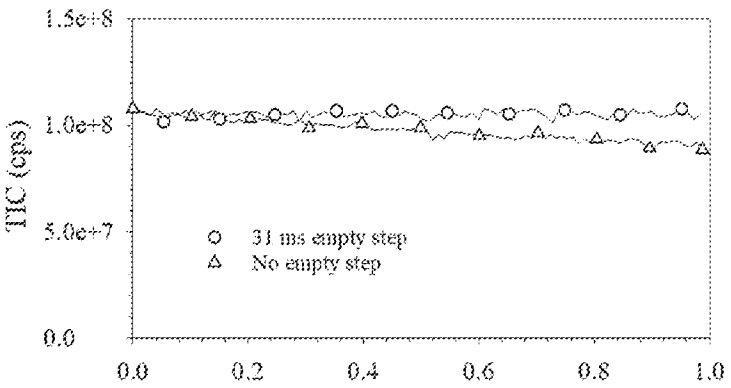
FIG. 8A depicts total ion current as a function of time at a fixed ST1 offset voltage for ions of m/z 791 through a conventional ST1/Q1 as depicted in FIGS. 2A-B.
Figure 8B:
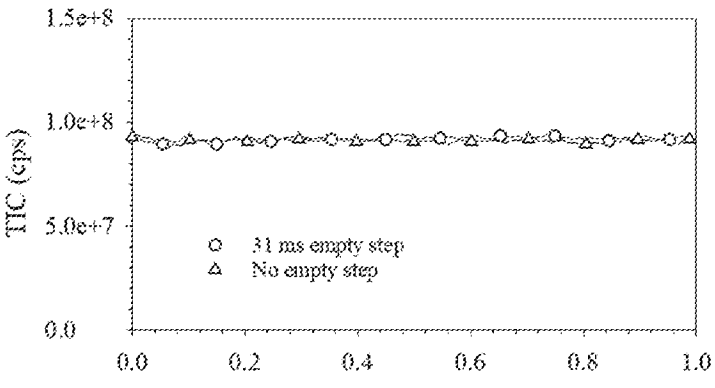
FIG. 8B depicts total ion current as a function of time at a fixed ST1 offset voltage for ions of m/z 791 through ST1/Q1 as schematically depicted in FIG. 6A in accordance with various aspects of the present teachings.

With reference now to FIGS. 8A-B, the TIC is depicted as a function of time under the same conditions as FIGS. 7A-B except that the DC offset voltage was fixed. For the conventional configuration (FIG. 8A), a DC offset voltage of −19.6 V DC was applied to ST1. For the modified ST1/Q1 configuration (FIG. 8B), TIC data was generated at a DC offset voltage of −57 V DC for ST1. As shown in FIG. 8A, the conventional configuration results in an unstable ion current that varies significantly based on whether an empty step is utilized. No such instability is observed in FIG. 8B, again indicating that the modified ST1/Q1 configuration described above (and schematically shown in FIG. 6A) was effective to prevent any trapped ions from interfering with the ion current stability.

Figure 9A:
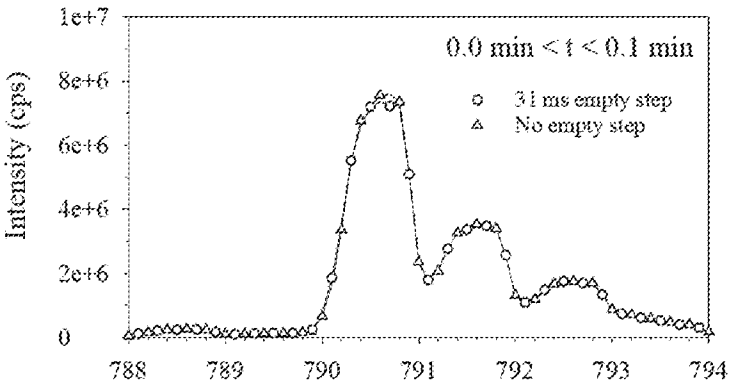
FIG. 9A depicts the mass spectra at a fixed ST1 offset voltage for ions of m/z 791 upon initiating transmission through a conventional ST1/Q1 as depicted in FIGS. 2A-B.
Figure 9B:
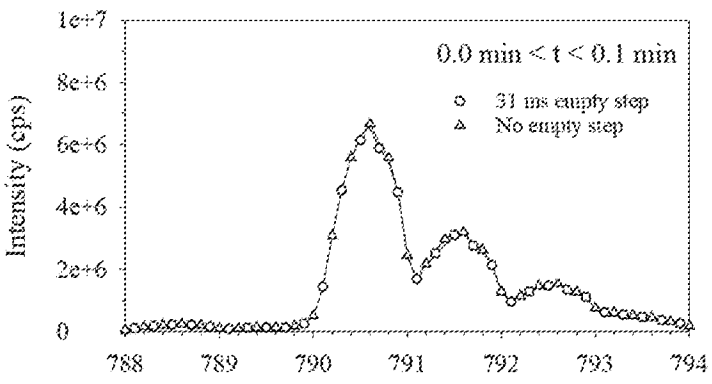
FIG. 9B depicts the mass spectra at a fixed ST1 offset voltage for ions of m/z 791 upon initiating transmission through ST1/Q1 as schematically depicted in FIG. 6A in accordance with various aspects of the present teachings.
Figure 10A:
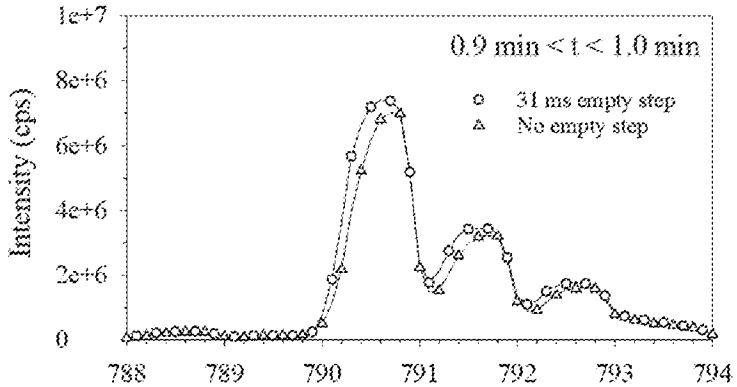
FIG. 10A depicts the mass spectra at a fixed ST1 offset voltage for ions of m/z 791 after a period of continuous transmission through a conventional ST1/Q1 as depicted in FIGS. 2A-B.
Figure 10B:
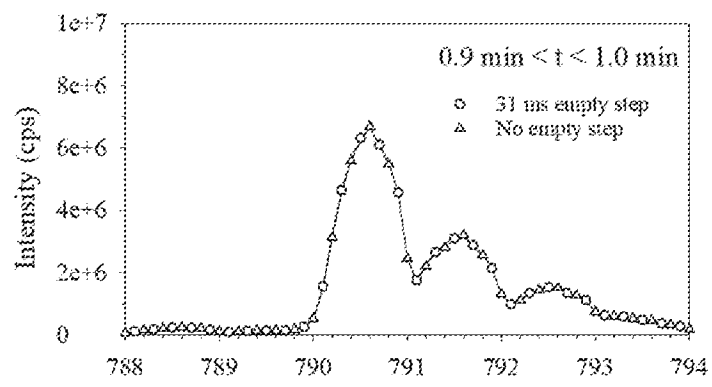
FIG. 10B depicts the mass spectra at a fixed ST1 offset voltage for ions of m/z 791 after a period of continuous transmission through ST1/Q1 as schematically depicted in FIG. 6A in accordance with various aspects of the present teachings.

To further test the effect on ion transmission, the mass spectra for m/z 791 was generated immediately upon initiating transmission (i.e., from 0 to 0.1 minutes of FIGS. 8A-B) and at the end of a continuous minute long transmission (i.e., from 0.9 to 1.0 minute of FIGS. 8A-B). With reference first to FIG. 9A, the conventional configuration results in only slight differences in peak intensity based on whether an empty step is utilized immediately upon initiating transmission, the differences of which may be statistically insignificant. FIG. 9B, which depicts the spectra over the same time period but with the modified ST1/Q1 configuration described above (schematically shown in FIG. 6A), shows nearly identical spectra (and intensities) regardless of the presence or absence of an empty step. However, differences in the spectra become more notably apparent later during the continuous transmission. As shown in FIG. 10A, the conventional configuration results in much more significant differences in both peak intensity and peak width between the case of with or without an empty step as the concentration of ions build up in ST1 relative to earlier during the transmission shown in FIG. 9A. However, FIG. 10B with the modified ST1/Q1 configuration again depicts nearly identical spectral shape (and intensities) regardless of the presence or absence of an empty step over the same time period, thereby indicating that ions trapped in ST1 over the course of the continuous transmission (if any) did not have a substantial impact on transmission through ST1.

Those skilled in the art will know or be able to ascertain using no more than routine experimentation, many equivalents to the embodiments and practices described herein. By way of example, the dimensions of the various components and explicit values for particular electrical signals (e.g., amplitude, frequencies, etc.) applied to the various components are merely exemplary and are not intended to limit the scope of the present teachings. Accordingly, it will be understood that the invention is not to be limited to the embodiments disclosed herein, but is to be understood from the following claims, which are to be interpreted as broadly as allowed under the law.

The section headings used herein are for organizational purposes only and are not to be construed as limiting. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

What is claimed is:

1. A method of reducing ion reflections between multipole segments in a mass spectrometer, generating an ion beam comprising a plurality of ions;

directing the ion beam through at least two multipole segments of a mass spectrometer, wherein each multipole segment includes a set of spaced-apart rod-shaped electrodes and a central opening through which ions can pass along a longitudinal axis and wherein the multipole segments are separated from each other by at least one boundary region along said longitudinal axis through which ions are drawn from an upstream segment to a downstream segment; and applying electrical signals to each of the rod-shaped electrodes of the upstream and downstream segments to set the effective potential of each segment and such that the effective potential of the upstream rod set is greater than or substantially equal to the effective potential of the downstream rod set so as to reduce reflection of ions passing through the boundary region.

2. The method of claim 1, wherein each of the multipole segments has a field radius defined by an inscribed circle between the innermost portions of each electrode, wherein the multipole segments are configured such that the field radius of the upstream segment is smaller than the field radius of the downstream segment.

3. The method of claim 1, wherein each of the upstream and downstream multipole segments is a quadrupole rod set having four cylindrical electrodes, the geometry of each quadrupole rod set being characterized by a ratio $R/r_0$, where R is the rod radius and $r_0$ is the radius of an inscribed circle that touches the electrode tips, and wherein $r_0$ of the upstream quadrupole rod set is at least 5 percent less than the $r_0$ of the downstream quadrupole rod set.

4. The method of claim 3, wherein the rod radius, $R_{up}$, of the rods of the upstream rod set is smaller than the $R_{down}$ of the rods of the downstream rod set.

5. The method of claim 4, wherein the rod radius, $R_{up}$, of the rods of the upstream rod set is at least 5 percent smaller than the $R_{down}$ of the rods of the downstream rod set.

6. The method of claim 1, wherein one of the upstream and downstream multipole segments are circumferentially rotated about the longitudinal axis relative to the other of the upstream and downstream multipole segments.

7. The method of claim 6, wherein one of the upstream and downstream multipole segments is circumferentially rotated relative to the other by at least 5 degrees;

and optionally wherein one of the upstream and downstream multipole segments is circumferentially rotated relative to the other in range from about 25 degrees to about 45 degrees.

8. The method of claim 1, wherein each of the rod-shaped electrodes of the upstream segment extends along a central axis and wherein the central axis of each of the rod-shaped electrodes of the upstream segment is not parallel to the longitudinal axis.

9. The method of claim 1, wherein the upstream multipole segment comprises a portion of a Q0 ion guide; and optionally wherein the upstream multipole segment is a Brubaker pre-filter.

10. The method of claim 1, wherein applying electrical signals to each of the rod-shaped electrodes of the upstream and downstream segments comprises adjusting the amplitude of the RF voltage applied to the upstream segment such that the q value of the upstream segment is equal to or greater than the q value of the downstream segment.

11. A mass spectrometer, comprising:

at least two multipole segments adjacent to each other along a longitudinal axis of the mass spectrometer such that a boundary region exists through which ions are transmitted from an upstream segment to a downstream segment, each multipole segment further comprising a set of spaced-apart rod-shaped electrodes disposed around the longitudinal axis and having a field radius defined by an inscribed circle between the innermost portions of each electrode, and one or more power supplies configured to provide electrical signals to each of the rod-shaped electrodes of the upstream and downstream segments, wherein an effective potential of the upstream rod set is greater than or substantially equal to the effective potential of the downstream rod set so as to reduce reflection of ions transmitted through the boundary region.

12. The mass spectrometer of claim 11, wherein the upstream multipole segment has a smaller field radius than the downstream segment.

13. The mass spectrometer of claim 12, wherein each of the upstream and downstream multipole segments comprises a quadrupole rod set having four cylindrical electrodes, the geometry of each quadrupole rod set being characterized by a ratio $R/r_0$, where R is the rod radius and $r_0$ is the radius of an inscribed circle that touches the electrode tips, and wherein $r_0$ of the upstream quadrupole rod set is at least 5 percent less than the $r_0$ of the downstream quadrupole rod set.

14. The mass spectrometer of claim 13, wherein the rod radius, R, of the rods of the upstream rod set is smaller than the R of the rods of the downstream rod set.

15. The mass spectrometer of claim 14, wherein the rod radius, R, of the rods of the upstream rod set is at least 5 percent smaller than the R of the rods of the downstream rod set.

16. The mass spectrometer of claim 11, wherein one of the upstream and downstream multipole segments is circumferentially rotated about the longitudinal axis relative to the other of the upstream and downstream multipole segments.

17. The mass spectrometer of claim 16, wherein one of the upstream and downstream multipole segments is circumferentially rotated relative to the other by at least 5 degrees; and optionally wherein one of the upstream and downstream multipole segments is circumferentially rotated relative to the other in a range from about 25 degrees to about 45 degrees.

18. The mass spectrometer of claim 17, wherein each of the rod-shaped electrodes of the upstream segment extends along a central axis and wherein the central axis of each of the rod-shaped electrodes of the upstream segment is not parallel to the longitudinal axis.

19. The mass spectrometer of claim 11, wherein the upstream multipole segment comprises a portion of a Q0 ion guide; and optionally wherein the upstream multipole segment is a Brubaker pre-filter.

20. The mass spectrometer of claim 11, wherein the electrical signals applied to each of the rod-shaped electrodes of the upstream and downstream segments are configured such that the q value of the upstream segment is equal to or greater than the q value of the downstream segment.

* * * * *